US012150508B2

(12) United States Patent
Wexelbaum

(10) Patent No.: US 12,150,508 B2
(45) **Date of Patent: *Nov. 26, 2024**

(54) REDUCING ABDOMINAL DISCOMFORT UTILIZING AN ADJUSTABLE BELT LOOP FASTENING DEVICE

(71) Applicant: Lucida, LLC, Naples, FL (US)

(72) Inventor: Joshua Wexelbaum, Naples, FL (US)

(73) Assignee: Lucida, LLC, Naples, FL (US)

( * ) Notice: Subject to any disclaimer, the term of this patent is extended or adjusted under 35 U.S.C. 154(b) by 280 days.

This patent is subject to a terminal disclaimer.

(21) Appl. No.: 17/865,604

(22) Filed: Jul. 15, 2022

(65) Prior Publication Data

US 2022/0346479 A1 Nov. 3, 2022

Related U.S. Application Data

(63) Continuation-in-part of application No. 16/788,698, filed on Feb. 12, 2020, now Pat. No. 11,419,373.

(60) Provisional application No. 62/804,814, filed on Feb. 13, 2019.

(51) Int. Cl.
*A41F 9/02* (2006.01)

(52) U.S. Cl.
CPC ..... *A41F 9/025* (2013.01)

(58) Field of Classification Search
CPC . A41F 9/02; A41F 9/007; A41F 9/025; A41D 2300/324; Y10T 24/316
See application file for complete search history.

(56) References Cited

U.S. PATENT DOCUMENTS

| | | | | | |
|---|---|---|---|---|---|
| 4,800,594 | A * | 1/1989 | Young | A41D 27/08 | 2/919 |
| 4,858,249 | A * | 8/1989 | Stewart | A41F 15/02 | 2/920 |
| 4,941,236 | A | 7/1990 | Sherman et al. | | |
| 5,423,789 | A | 6/1995 | Kuen | | |
| 5,566,397 | A * | 10/1996 | Scott | A41F 9/025 | 24/301 |
| 6,163,937 | A * | 12/2000 | McKinnis | A41F 15/02 | 2/323 |
| 6,892,428 | B2 | 5/2005 | Reiter | | |
| 7,086,126 | B2 * | 8/2006 | English | A41F 9/02 | 24/301 |
| 7,410,407 | B2 * | 8/2008 | Krammel | A41F 15/02 | 450/86 |

(Continued)

FOREIGN PATENT DOCUMENTS

| | | | |
|---|---|---|---|
| GB | 1312683 | A | 4/1973 |
| JP | 2002105727 | A | 4/2002 |
| JP | 6518862 | B1 | 5/2019 |

*Primary Examiner* — Robert Sandy
*Assistant Examiner* — Louis A Mercado
(74) *Attorney, Agent, or Firm* — Shumaker, Loop & Kendrick, LLP

(57) ABSTRACT

Adjustable belt loop fastening devices and associated methods of using the same to extend between two or more belt loops on a garment and to selectively lessen the distance there between the belt loops to secure the waistline of a garment to a wearer while concurrently minimizing the force and/or pressure applied to the wearer's abdominal region, especially for wearer's having chronic diseases and/or illnesses (e.g., Crohn's disease, irritable bowel syndrome, colitis, etc.) that frequently result in increased abdominal sensitivity and tenderness.

20 Claims, 20 Drawing Sheets

(56) References Cited

U.S. PATENT DOCUMENTS

| | | | | |
|---|---|---|---|---|
| 7,566,328 | B2 | 7/2009 | Hooper | |
| 7,895,673 | B2 | 3/2011 | Forselius et al. | |
| D676,627 | S * | 2/2013 | Doss | D2/624 |
| D750,343 | S * | 3/2016 | Biesel | D2/627 |
| D944,489 | S * | 3/2022 | Wexelbaum | D2/627 |
| D946,241 | S * | 3/2022 | Kjar | D2/853 |
| D955,569 | S * | 6/2022 | Weighill | D24/128 |
| 11,419,373 | B2 * | 8/2022 | Wexelbaum | A41F 9/007 |
| 11,576,451 | B2 * | 2/2023 | Wexelbaum | A41F 9/007 |
| 2009/0089985 | A1 | 4/2009 | Cazella et al. | |
| 2009/0139014 | A1 | 6/2009 | Trochlil-Crist | |
| 2010/0162468 | A1 | 7/2010 | Hanson | |
| 2010/0235967 | A1 | 9/2010 | Janakus et al. | |
| 2011/0252604 | A1 * | 10/2011 | Hansen | B65D 63/10 24/301 |
| 2015/0272249 | A1 | 10/2015 | Glenn | |
| 2018/0116320 | A1 | 5/2018 | Kjar | |
| 2019/0200694 | A1 | 7/2019 | Kjar | |
| 2020/0253309 | A1 | 8/2020 | Wexlbaum | |

* cited by examiner

REDUCING ABDOMINAL DISCOMFORT UTILIZING AN ADJUSTABLE BELT LOOP FASTENING DEVICE

FIELD

The present invention relates to fastening devices, and more particularly, to adjustable belt loop fastening device(s) that extend between two or more belt loops and selectively lessen the distance there between to secure the waistline of a garment to a wearer while concurrently minimizing the force and/or pressure applied to the abdominal region of a wearer.

BACKGROUND

Belts are traditional fastening devices used to reduce the overall waistline of a garment while further securing a garment to a wearer. Belts come in many forms (e.g., utilitarian forms devoid of decoration or aesthetically pleasing/decorative forms) and are often used with work, casual, and formal attire such as shorts, jeans, and dress slacks. While belts are very effective for securing a garment to a wearer and concurrently reducing a garment's overall waistline, problems exist with belt usage for those afflicted with various chronic illnesses and/or diseases (e.g., various inflammatory diseases) that are often associated with increased sensitivity and tenderness of the abdominal wall/lining. For example, people afflicted with Crohn's disease, irritable bowel syndrome (IBS), colitis, and/or other maladies affecting the gut and intestines often experience sharp pains and exhibit highly increased sensitivity and tenderness of the abdominal wall/lining, primarily in the rectus abdominis region and occasionally within the oblique region as well.

Due to increased abdominal sensitivity and tenderness in individuals afflicted with the above mentioned chronic illnesses/diseases, belt usage and the abdominal pressure applied by the belt to ones abdomen often leads to great discomfort requiring constant readjustment of the belt in an attempt to mitigate this discomfort while concurrently attempting to best secure the garment on the wearer. In many instances, this discomfort cannot be mitigated and people are forced to endure this discomfort while wearing the belt to securely maintain their garments in an appropriately desired position. However, in other instances, the discomfort and displeasure of wearing the belt becomes too great leading one to discontinue belt usage, thus resulting in an ill-fitting garment that constantly slips along the wearer's waist and further requires constant readjustment to properly maintain positioning of the garment on the wearer.

To further compound the above mentioned problems, ones afflicted with the above mentioned illnesses and/or diseases often experience vast weight fluctuation(s) associated with inflammation of the gut, intestines, and/or abdomen—frequently losing vast amounts of weight when (i) their condition is at its worst, (ii) abdominal sensitivity/tenderness is at its greatest, and (iii) when belts usage is needed the most to potentially secure an ill-fitting garment to the wearer. Thus, as detailed above, a problem clearly exists with belt usage especially in individuals having various chronic illnesses/diseases affecting the gut, intestines, and/or abdomen, and a viable alternative that alleviates the above mentioned problems (e.g., application of force/pressure on the abdomen and discomfort/displeasure associated therewith) while concurrently securing a garment to the wearer is direly needed.

BRIEF SUMMARY

Embodiments of the present invention address the above needs and/or achieve other advantages by providing systems, apparatuses, and methods related to adjustable belt loop fastening devices configured to extend between two or more belt loops on a garment and to selectively lessen the distance there between the belt loops to secure the waistline of a garment to a wearer while concurrently minimizing the force and/or pressure applied to the wearer's abdominal region, especially for wearer's having chronic diseases and/or illnesses (e.g., Crohn's disease, irritable bowel syndrome, colitis, etc.) that frequently result in increased abdominal sensitivity and tenderness.

In certain aspects, the adjustable belt loop fastening device includes an elongate sheath and a plurality of fasteners positioned thereon. In certain aspects, the elongate sheath includes a first end and a second end that are spaced apart by but connected to one another by a foldable portion positioned there between. The elongate sheath further includes upper and lower planar faces, and the elongate sheath is further foldable and resiliently deformable such that (i) the upper and lower planar faces reside in parallel planes while the device is not in use, and (ii) while in use, certain portions of the upper and lower planar faces overlap and reside in intersecting planes.

In certain aspects, a first plurality of fasteners are positioned within the first end of the elongate sheath, the first plurality of fasteners extending above an outermost surface of the upper planar face of the elongate sheath in a direction extending away from the device.

In certain aspects, a second plurality of fasteners positioned within the second end of the elongate sheath, the second plurality of fasteners extending above an outermost surface of the lower planar face of the elongate sheath in a direction extending away from the device.

In certain aspects, the elongate sheath is configured to fold within the foldable portion of the elongate sheath such that at least one fastener from the first plurality of fasteners engages with at least one fastener from the second plurality of fasteners such that portions of the upper and lower planar faces and portions of the first and second ends of the elongate sheath are adjacent to one another while the device is in use selectively lessening the distance between belt loops to secure the garment waistline to the wearer while concurrently selectively minimizing force applied to an abdominal region of the wearer.

In certain aspects, the first and second plurality fasteners are snap fit buttons configured to securely engage one another while the device is in use.

In certain aspects, the first and second plurality fasteners are magnets of opposite polarity configured to securely engage one another while the device is in use.

In certain aspects, also disclosed is a method of selectively lessening the distance between a plurality of belt loops including (a) threading the adjustable belt loop device disclosed herein between a plurality of belt loops; and (b) engaging at least one fastener from the plurality of first fasteners with at least one fastener from the second plurality of fasteners such that portions of the upper and lower planar faces and portions of the first and second ends of the elongate sheath are adjacent to one another and selectively lessen the distance between belt loops thereby secure the garment waistline to the wearer while concurrently selectively minimizing force applied to an abdominal region of the wearer. In certain aspects, the method includes a plurality of adjustable belt loop devices are provided and threaded within and engaged different pluralities of belt loops to selectively lessen multiple portions of the garment waistline.

Also disclosed herein are adjustable belt loop fastening devices configured to extend between and be directly affixed to a plurality of belt loops on a garment instead of directly on the garment's waistline and, while in use and affixed to the plurality of belt loops, to selectively lessen distance between belt loops by gripping and applying force directly to the belt loops to bias two belts loops towards one another to secure the garment waistline to a wearer while concurrently selectively minimizing force applied to an abdominal region of the wearer. The adjustable belt loop fastening device includes an elongate sheath having a first end, a connecting portion, and a second end in which the first and second ends are each connected to but spaced apart from one another by the connecting portion positioned there between, the elongate sheath having upper planar and lower planar faces in which fasteners are only positioned on the lower planar face. In this aspect, the first and second ends of the elongate sheath are configured to wrap around and grip separate belt loops of a wearer's garment and selectively lessen distance between the separate belt loops when the first and/or second end of the elongate sheath are advanced towards one another by gripping and applying force directly to the belt loops to bias two belts loops towards one another while the first and second ends of the elongate sheath remain substantially coplanar to one another while the device is in use and affixed to the separate belt loops.

In certain aspects, the first end, second end, and connecting portion comprise hook and loop fasteners positioned thereon in which the first and second ends comprise the same hook or loop fastener and the connecting portion comprises a complimentary hook or loop fastener configured to engage the first and second ends while the device is in use.

In certain aspects, the first and second ends comprise different fasteners.

In certain aspects, the first end comprises snap fit buttons configured to securely engage one another while concurrently being affixed to and gripping one belt loop while the device is in use, and the connecting portion and second end comprise complimentary hook and loop fasteners so that the second end engages the connecting portion while concurrently being affixed to and gripping another belt loop while the device is in use.

In certain aspects, the first end comprises a rigid hook having a recessed portion that is configured to receive and securely engage one belt loop therein while the device is in use, and the connecting portion and second end comprise complimentary hook and loop fasteners so that the second end engages the connecting portion while concurrently being affixed to and gripping another belt loop while the device is in use.

In certain aspects, the first end comprises a first and second magnet having opposite polarities that are embedded within the first end of the elongate sheath and that are foldable so that the magnets engage one another while the first end engages one belt loop while the device is in use, and the connecting portion and second end comprise complimentary hook and loop fasteners so that the second end engages the connecting portion while concurrently being affixed to and gripping another belt loop while the device is in use.

In certain aspects, also disclosed is a method of selectively lessening the distance between a plurality of belt loops including (a) threading the adjustable belt loop device disclosed herein between a plurality of belt loops; (b) engaging and securing first belt loop within a first end of the device; and (c) applying force towards a second belt loop by pulling the second end of the adjustable belt loop device in a direction opposite the first belt loop; and engaging the second end of the adjustable belt loop device to another portion of the device to selectively lessen distance between the first and second belt loops by gripping and applying force directly to the belt loops to bias the first and second belts loops towards one another while the first and second ends of the elongate sheath remain substantially coplanar relative to one another while the device is in use and affixed to the separate belt loops.

In certain aspects, also disclosed is a kit including one or a plurality of any of the adjustable belt loop fastening device(s) disclosed herein and packaging with the one or plurality of adjustable belt loop fastening device(s) packaged therein.

In another aspect, the present subject matter is direct to a method of securing a garment to a wearer while selectively reducing abdominal discomfort. The method includes threading an adjustable belt loop fastening device between a plurality of belt loops. Additionally, the method includes engaging and securing a first belt loop within a first end of the device. The method further includes applying force towards a second belt loop by pulling a second end of the adjustable belt loop fastening device in a direction opposite the first belt loop. The method also includes engaging the second end of the adjustable belt loop fastening device to another portion of the device to selectively lessen distance between the first and second belt loops by gripping and applying force directly to the belt loops to bias the first and second belts loops towards one another while the first and second ends of an elongate sheath of the device remain substantially coplanar relative to one another while the device is in use such that the garment is secured to the wearer while reducing abdominal pressure applied by the garment to the wearer. Furthermore, the adjustable belt loop fastening device includes the elongate sheath having a first end, a second end, and a connecting portion. The first and second ends are each connected to but spaced apart from one another by the connecting portion positioned there between. The elongate sheath has upper planar and lower planar faces, in which fasteners are only positioned on the lower planar face such that the first and second ends of the elongate sheath are configured to wrap around and grip separate belt loops of a wearer's garment to selectively lessen distance between the separate belt loops when the first end and/or the second end of the elongate sheath are advanced towards one another and fastened on the device. Additionally, the first end, the second end, and the connecting portion include hook and loop fasteners positioned thereon. The first and second ends include the same hook or loop fastener, and the connecting portion includes a complimentary hook or loop fastener configured to securely engage the first and second ends while the device is in use. The hook and loop fasteners are continuously arranged on the device such that the hook and loop fasteners directly contact one another when the adjustable belt loop fastening device is in use and when the device is completely open in a flat position.

In at least one embodiment, the elongate sheath may have a length defined between the first end and the second end configured to only extend a distance between a first consecutive belt loop and second consecutive belt loop of the plurality of belt loops when affixed to the plurality of belt loops. Additionally or alternatively, the elongate sheath may have a length defined between the first end and the second end configured to be less than a distance between a first consecutive belt loop and a third consecutive belt loop of the plurality of belt loops when threaded through the plurality of belt loops.

In some embodiments, the method may further include threading a second adjustable belt loop fastening device between the plurality of belt loops. Such an embodiment may include engaging and securing a third belt loop within a first end of the second device. Such a method may further include applying force towards a fourth belt loop by pulling a second end of the second adjustable belt loop fastening device in a direction opposite the third belt loop. In additional or alternative such embodiments, the method may include engaging the second end of the second adjustable belt loop fastening device to another portion of the device to selectively lessen distance between the third and fourth belt loops by gripping and applying force directly to the belt loops to bias the third and fourth belt loops towards one another while the first and second ends of an elongate sheath of the second device remain substantially coplanar relative to one another while the device is in use such that the garment is secured to the wearer while reducing abdominal pressure applied by the garment to the wearer. The second adjustable belt loop fastening device may be configured the same as the adjustable belt loop fastening device secured between the first and second belt loops.

In an additional or alternative embodiment, the method may further include threading a third adjustable belt loop fastening device between the plurality of belt loops. Such an embodiment may further include engaging and securing a fifth belt loop within a first end of the third device. In some such embodiments, the method may include applying force towards a sixth belt loop by pulling a second end of the third adjustable belt loop fastening device in a direction opposite the fifth belt loop. In some such embodiments, the method may include engaging the second end of the third adjustable belt loop fastening device to another portion of the device to selectively lessen distance between the fifth and sixth belt loops by gripping and applying force directly to the belt loops to bias the fifth and sixth belt loops towards one another while the first and second ends of an elongate sheath of the third device remain substantially coplanar relative to one another while the device is in use such that the garment is secured to the wearer while reducing abdominal pressure applied by the garment to the wearer. The third adjustable belt loop fastening device may be configured the same as the adjustable belt loop fastening device secured between the first and second belt loops.

In some embodiments, the elongate sheath may be a semi-rigid material. Additionally or alternatively, the elongate sheath may be a non-deformable material. In further or alternative embodiments, the elongate sheath may be a semi-rigid and non-deformable material. Additionally or alternatively, the elongate sheath may include one of a woven fabric, a non-woven fabric, or a leather strap.

In another aspect, the present subject matter is direct to a method of securing a garment to a wearer while selectively reducing abdominal discomfort. The method includes threading an adjustable belt loop fastening device disclosed herein between a plurality of belt loops. The method also includes engaging and securing a first belt loop within a first end of the device. The method further includes applying force towards a second belt loop by pulling a second end of the adjustable belt loop fastening device in a direction opposite the first belt loop. Additionally, the method includes engaging the second end of the adjustable belt loop fastening device to another portion of the device to selectively lessen distance between the first and second belt loops by gripping and applying force directly to the belt loops to bias the first and second belts loops towards one another while the first and second ends of an elongate sheath of the device remain substantially coplanar relative to one another while the device is in use such that the garment is secured to the wearer while reducing abdominal pressure applied by the garment to the wearer. The first and second ends are each connected to but spaced apart from one another by the connecting portion positioned there between. The elongate sheath has upper planar and lower planar faces, in which fasteners are only positioned on the lower planar face such that the first and second ends of the elongate sheath are configured to wrap around and grip separate belt loops of a wearer's garment to selectively lessen distance between the separate belt loops when the first end and/or the second end of the elongate sheath are advanced towards one another and fastened on the device. The first and second ends include different fasteners, the first end configured to securely engage one belt loop of the belt loops while the device is in use. The connecting portion and the second end include complimentary hook and loop fasteners so that the second end securely engages the connecting portion while concurrently being affixed to and gripping another belt loop while the device is in use. The hook and loop fasteners are continuously arranged on the device such that the hook and loop fasteners directly contact one another when the adjustable belt loop fastening device is in use and when the device is completely open in a flat position.

In at least one embodiment, the first end may include snap fit buttons configured to securely engage one another while concurrently being affixed to and gripping the one belt loop of the belt loops while the device is in use. Additionally or alternatively, the elongate sheath may have a length defined between the first end and the second end configured to only extend a distance between a first consecutive belt loop and second consecutive belt loop of the plurality of belt loops when affixed to the plurality of belt loops. In additional or alternative embodiments, the length may be configured to be less than a distance between the first consecutive belt loop and a third consecutive belt loop of the plurality of belt loops when threaded through the plurality of belt loops.

In an additional or alternative embodiment, the first end may include a rigid hook permanently affixed thereto having an internal recess configured to receive and securely engage the one belt loop of the belt loops therein while the device is in use. Additionally or alternatively, the elongate sheath may have a length defined between the first end and the second end configured to only extend a distance between a first consecutive belt loop and second consecutive belt loop of the plurality of belt loops when affixed to the plurality of belt loops. In additional or alternative embodiments, the length may be configured to be less than a distance between the first consecutive belt loop and a third consecutive belt loop of the plurality of belt loops when threaded through the plurality of belt loops.

In some embodiments, the first end comprises a first magnet and second magnet having opposite polarities that are embedded within the first end of the elongate sheath and that are foldable so that the magnets securely engage one another while the first end securely engages the one belt loop of the belt loops therein while the device is in use. Additionally or alternatively, the elongate sheath may have a length defined between the first end and the second end configured to only extend a distance between a first consecutive belt loop and second consecutive belt loop of the plurality of belt loops when affixed to the plurality of belt loops. In additional or alternative embodiments, the length may be configured to be less than a distance between the first consecutive belt loop and a third consecutive belt loop of the plurality of belt loops when threaded through the plurality of belt loops.

In another aspect, the present subject matter is directed to an adjustable belt loop fastening device configured to extend between and be directly affixed to a plurality of belt loops on a garment instead of directly on a garment waistline and, while in use and affixed to the plurality of belt loops, to selectively lessen distance between belt loops by gripping and applying force directly to the belt loops to bias two belts loops towards one another to secure the garment waistline to a wearer while concurrently selectively minimizing force applied to an abdominal region of the wearer. The adjustable belt loop fastening device includes an elongate sheath having a first end, a connecting portion, and a second end. The first and second ends are each connected to but spaced apart from one another by the connecting portion positioned there between. The elongate sheath has a length defined between the first end and the second end configured to be less than a distance between a first consecutive belt loop and a third consecutive belt loop of the plurality of belt loops. The elongate sheath has upper planar and lower planar faces, in which fasteners are only positioned on the lower planar face such that the first and second ends of the elongate sheath are configured to wrap around and grip separate belt loops of a wearer's garment to selectively lessen distance between the separate belt loops when the first end and/or the second end of the elongate sheath are advanced towards one another and fastened on the device by gripping and applying force directly to the belt loops to bias two belts loops towards one another. The first and second ends of the elongate sheath remain substantially coplanar relative to one another while the device is in use and affixed to the separate belt loops. Additionally, the first end, the second end, and the connecting portion include hook and loop fasteners positioned thereon. The first and second ends include the same hook or loop fastener, and the connecting portion includes a complimentary hook or loop fastener configured to securely engage the first and second ends while the device is in use. The hook and loop fasteners are continuously arranged on the device such that the hook and loop fasteners directly contact one another when the adjustable belt loop fastening device is in use and when the device is completely open in a flat position.

The features, functions, and advantages that have been discussed may be achieved independently in various embodiments of the present invention or may be combined in yet other embodiments, further details of which can be seen with reference to the following description and drawings. Embodiments of the invention can include one or more or any combination of the above features and configurations.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE SEVERAL VIEWS OF THE DRAWINGS

These and other features, aspects and advantages of the present invention are better understood when the following detailed description of the invention is read with reference to the accompanying drawings, in which.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout. Unless described or implied as exclusive alternatives, features throughout the drawings and descriptions should be taken as cumulative, such that features expressly associated with some particular embodiments can be combined with other embodiments. Unless defined otherwise, technical and scientific terms used herein have the same meaning as commonly understood to one of ordinary skill in the art to which the presently disclosed subject matter pertains.

The exemplary embodiments are provided so that this disclosure will be both thorough and complete, and will fully convey the scope of the invention and enable one of ordinary skill in the art to make, use, and practice the invention.

The terms "coupled," "fixed," "attached to," "communicatively coupled to," "operatively coupled to," and the like refer to both (i) direct connecting, coupling, fixing, attaching, communicatively coupling, and operatively coupling; and (ii) indirect connecting coupling, fixing, attaching, communicatively coupling, and operatively coupling via one or more intermediate components or features, unless otherwise specified herein. "Communicatively coupled to" and "operatively coupled to" can refer to physically and/or electrically related components.

While certain exemplary embodiments have been described and shown in the accompanying drawings, it is to be understood that such embodiments are merely illustrative of, and not restrictive on, the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the herein described embodiments can be configured without departing from the scope and spirit of the invention. Therefore, it is to be understood that, within the scope of the included claims, the invention may be practiced other than as specifically described herein.

Figure 1:
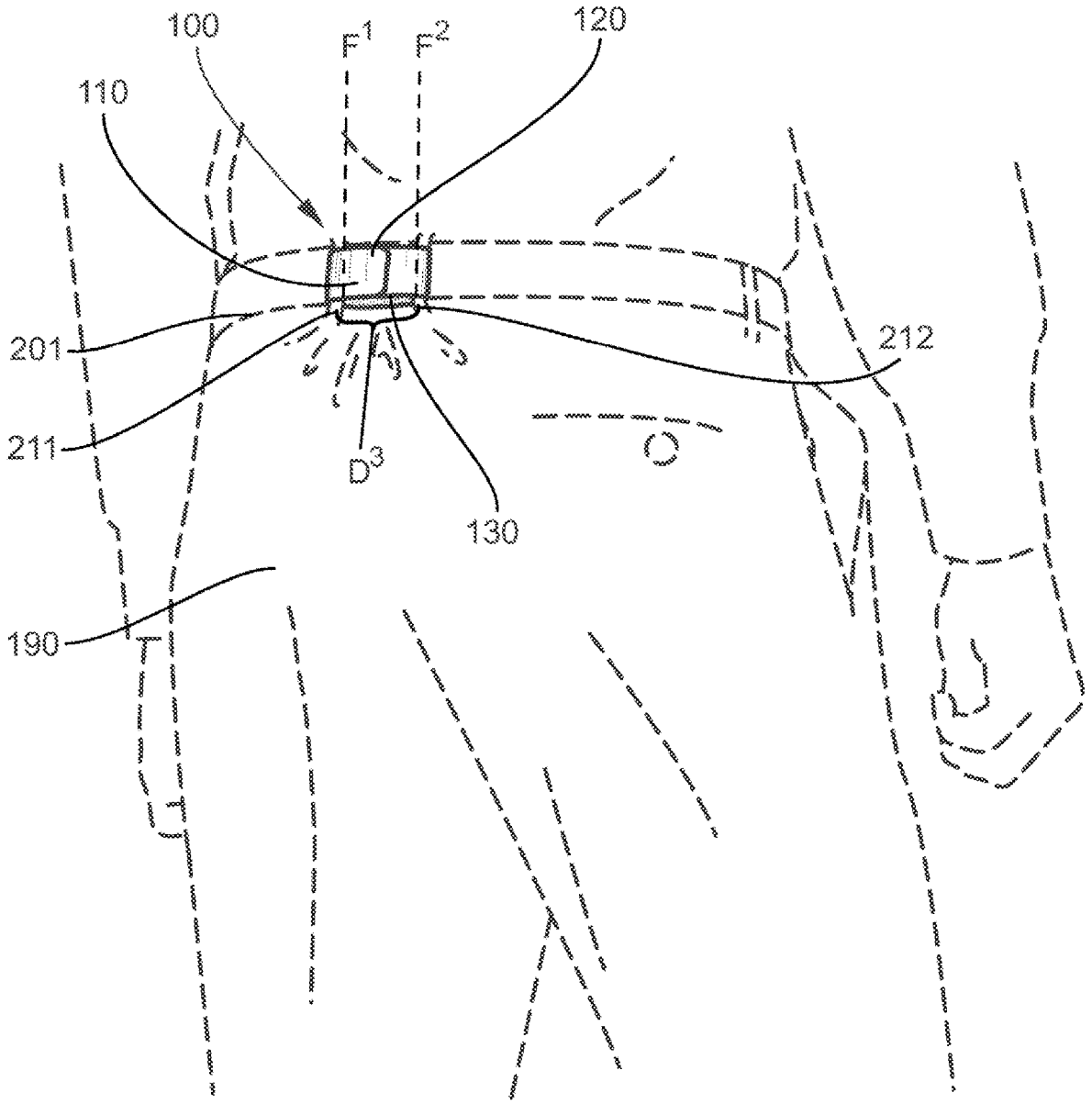
FIG. 1 is an environmental view of the adjustable belt loop fastening device in use.

FIGS. 1-8 depict the adjustable belt loop fastening device 100 disclosed herein, and FIG. 1 more specifically depicts the device 100 while in use—being threaded through a plurality of belt loops 211, 212 of the garment 190 to selectively lessen the distance (D3) there between the belt loops 211, 212 to secure the waistline 201 of a garment 190 to a wearer while concurrently minimizing the force and/or pressure applied to the wearer's abdominal region, especially for wearer's having chronic diseases and/or illnesses (e.g., Crohn's disease, irritable bowel).

As shown specifically in FIGS. 2-8, the adjustable belt loop fastening device 100 includes an elongate sheath 110 formed of a woven, nonwoven, and/or a compressible elastomeric material (e.g., a natural or synthetic rubber containing material such as neoprene). The elongate sheath is resiliently deformable and may have one-way stretch properties (i.e., ability to stretch more or less along one axis relative to another axis) along the longitudinal axis (L1 in FIGS. 6 and 7) of the elongate sheath 110 or may have unidirectional stretch properties (i.e., the same stretching properties along all axes). In certain preferred aspects, the elongate sheath 110 is a resiliently deformable material having unidirectional stretch properties thus allowing various forces to be exerted on the sheath 110 in all directions while the device 100 is in use but with the sheath reacting to these forces in a substantially similar and uniform manner throughout the sheath to further ensure proper functioning of the device when engaged with belt loops, and in certain aspects to further ensure this uniformity, the elongate sheath is continuously formed and devoid of any openings and/or gaps except for the plurality of fasteners (discussed further below) positioned therein.

Figure 2:
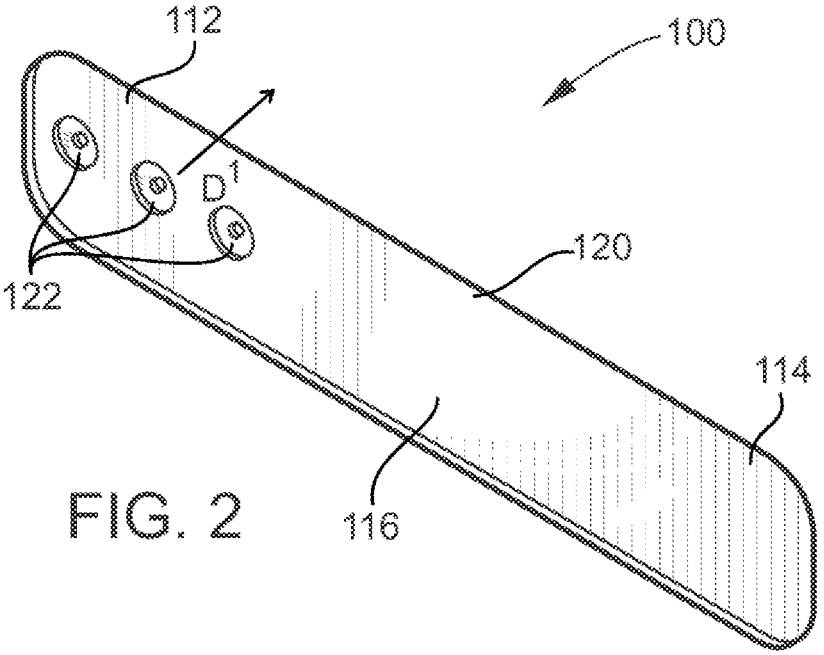
FIG. 2 is a top perspective view of the adjustable belt loop fastening device.
Figure 3:
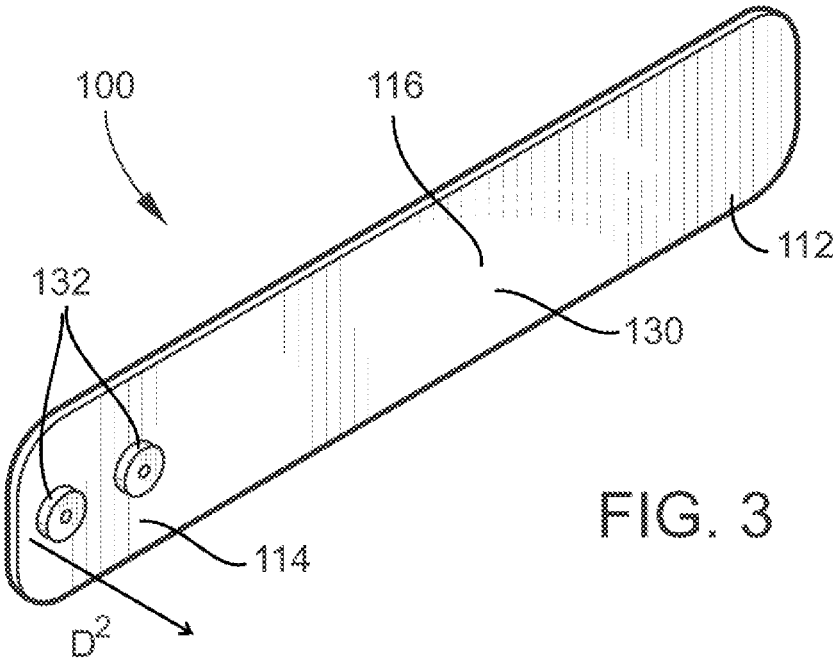
FIG. 3 is a bottom perspective view of the adjustable belt loop fastening device.
Figure 4:
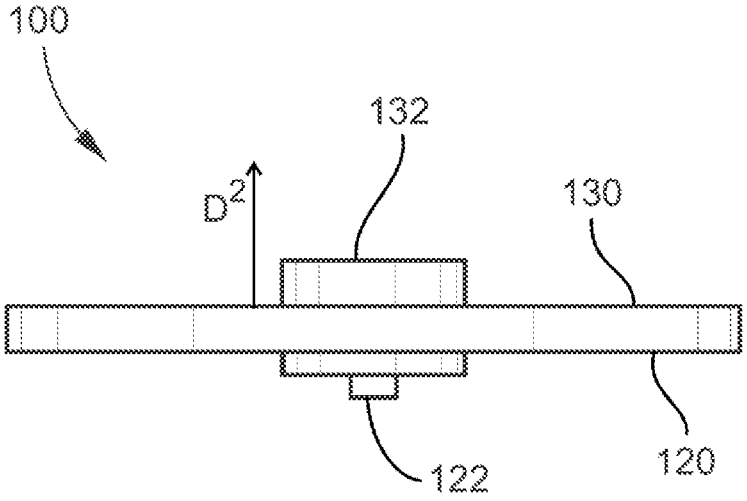
FIG. 4 is a front view of the adjustable belt loop fastening device.
Figure 5:
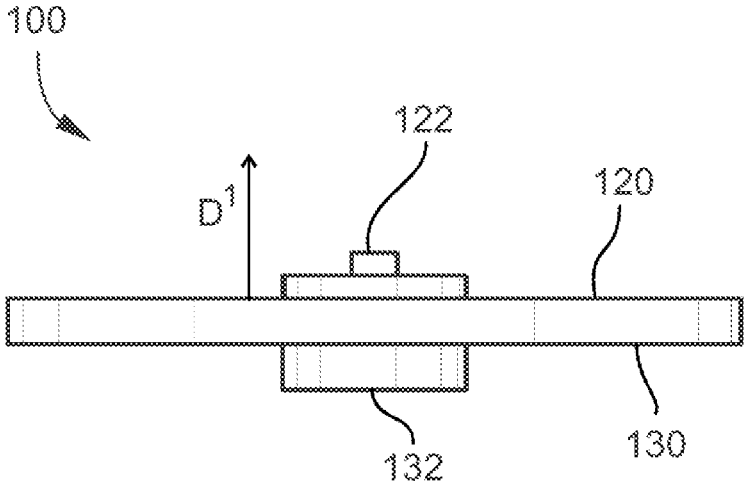
FIG. 5 is a back view of the adjustable belt loop fastening device.

As shown, for example, in FIGS. 2 and 3, the elongate sheath 110 includes a first end 112 and a second end 114 that are spaced apart from one another. The first end 112 and second ends 114 are connected to one another by a foldable portion 116 positioned there between along the length of the elongate sheath 110. As further shown in FIGS. 2, 3, 6, and 7, the elongate sheath 110 further includes upper 120 and lower planar faces 130. While in use and engaging a plurality of belt loops, the elongate sheath 110 is further foldable, for example, about an axis that is transverse to the longitudinal axis (L1 in FIGS. 6 and 7) of the sheath 110 and is resiliently deformable such that (i) the upper and lower planar faces reside in parallel planes while the device is not in use (e.g., FIGS. 2 and 3) and (ii) while in use (e.g., FIG. 1), certain portions of the upper and lower planar faces reside in intersecting planes and overlap with one another and/or are directly adjacent to one another.

Figure 6:
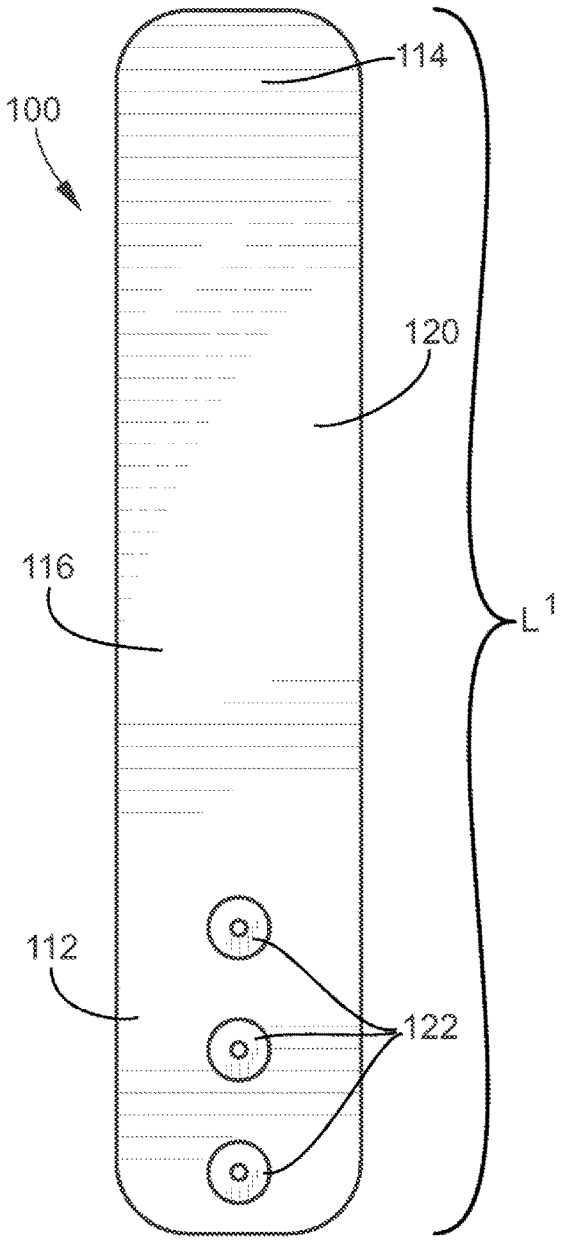
FIG. 6 is a top view of the adjustable belt loop fastening device.

In certain aspects and as further shown in FIGS. 2 and 6, a first plurality of fasteners 122 are positioned within the first end 112 of the elongate sheath 110. The first plurality of fasteners 122 are preferably permanently anchored within and at least partially encased by the material forming the elongate sheath 110. As further shown in FIGS. 2 and 5, the first plurality of fasteners 122 extend above an outermost surface of the upper planar face 120 of the elongate sheath 110 in a direction (D1) extending away from the device 100.

Figure 7:
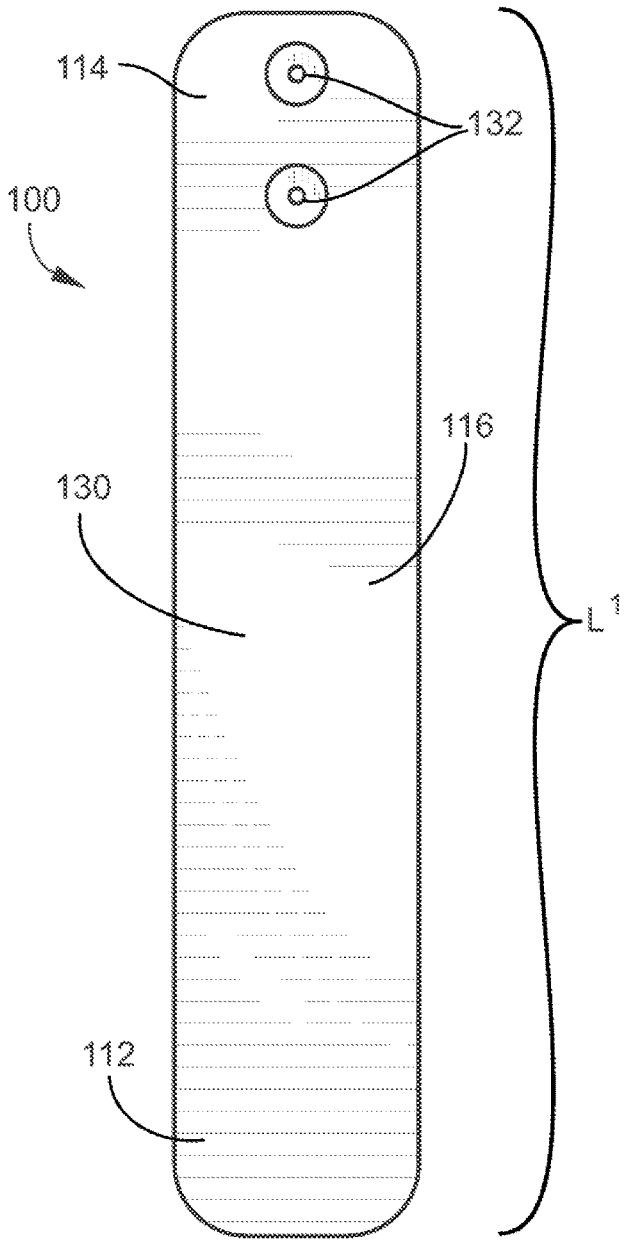
FIG. 7 is a bottom view of the adjustable belt loop fastening device.
Figure 8:
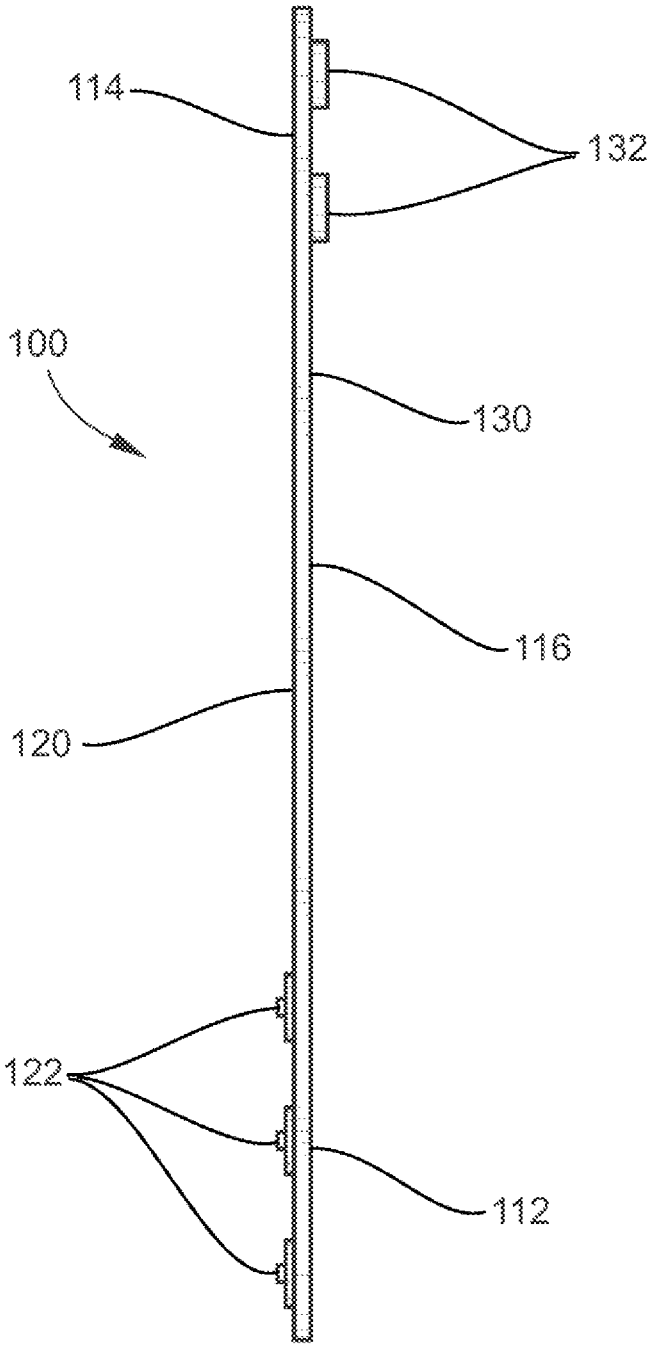
FIG. 8 is a right side view, with the left side view being a mirror image thereof.
Figure 9:
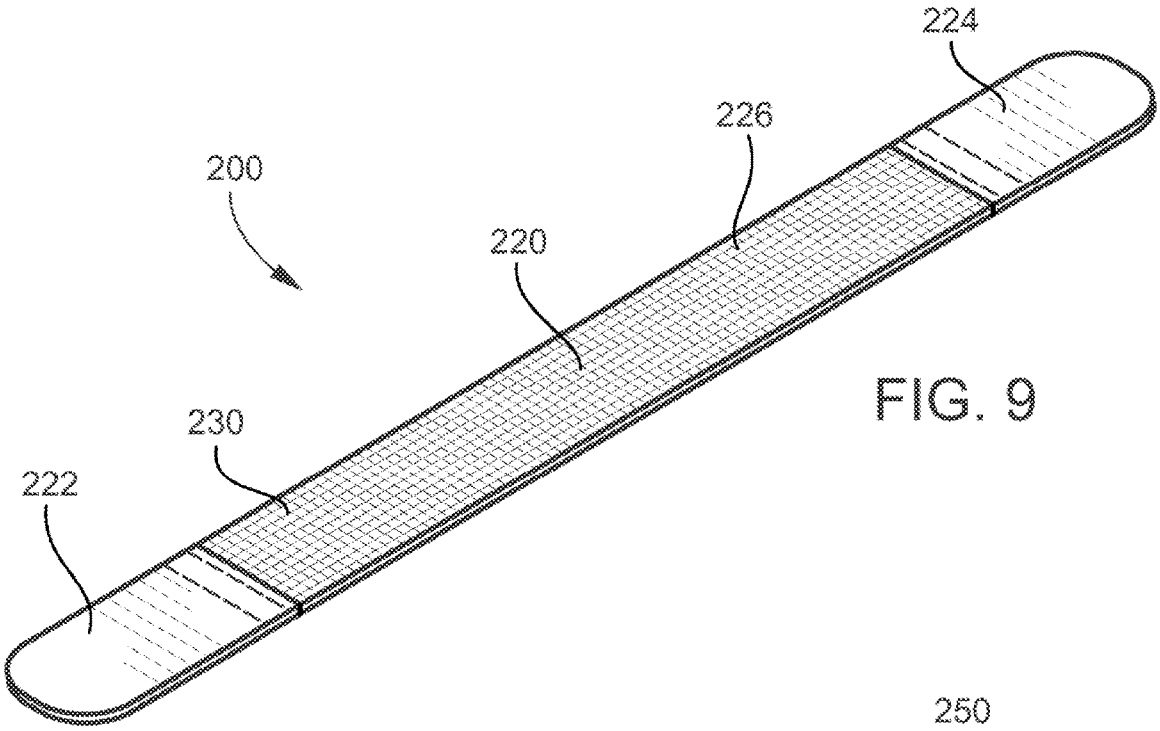
FIG. 9 is a top perspective view of the adjustable belt loop fastening device according to a second embodiment.
Figure 10:
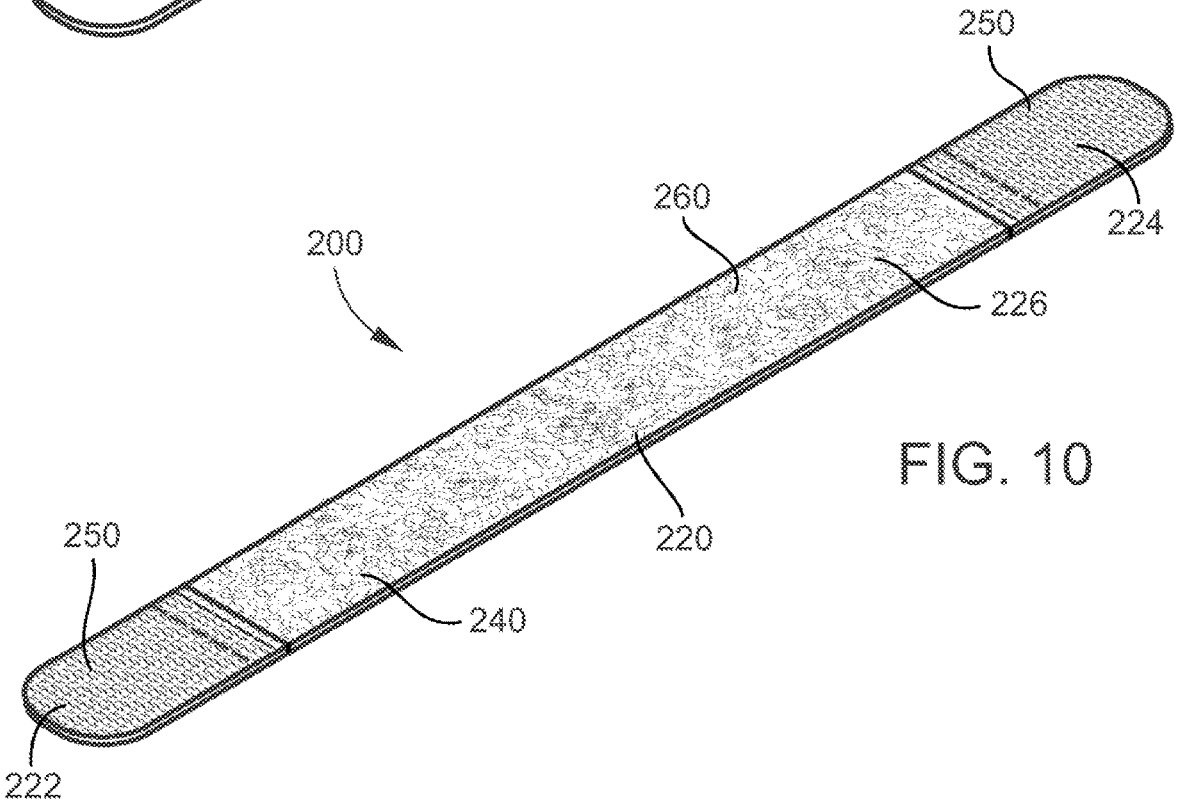
FIG. 10 is a bottom perspective view of the adjustable belt loop fastening device according to the second embodiment having hook and loop fasteners positioned thereon.
Figure 11:
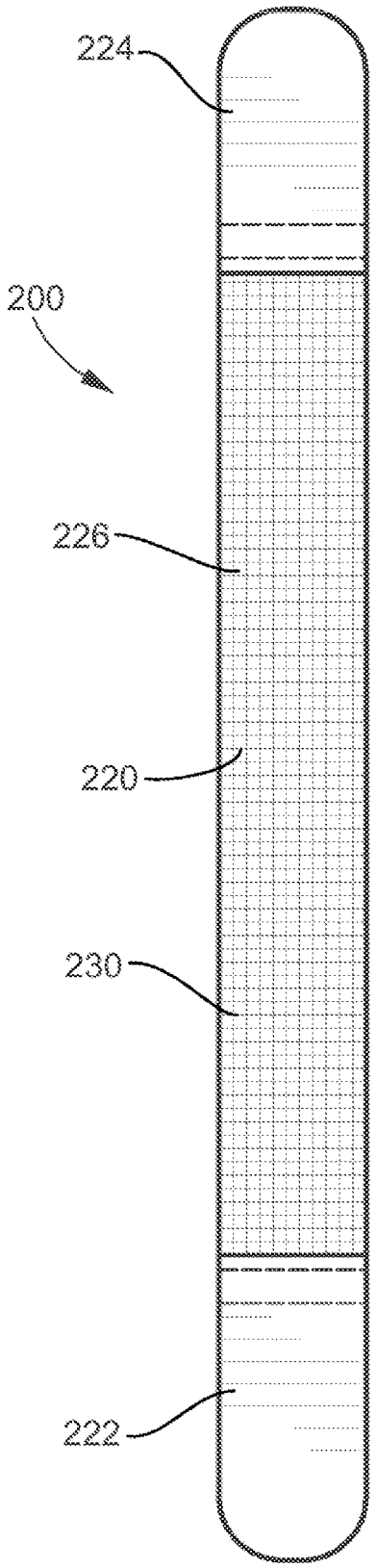
FIG. 11 is a top view of the adjustable belt loop fastening device according to the second embodiment.
Figure 12:
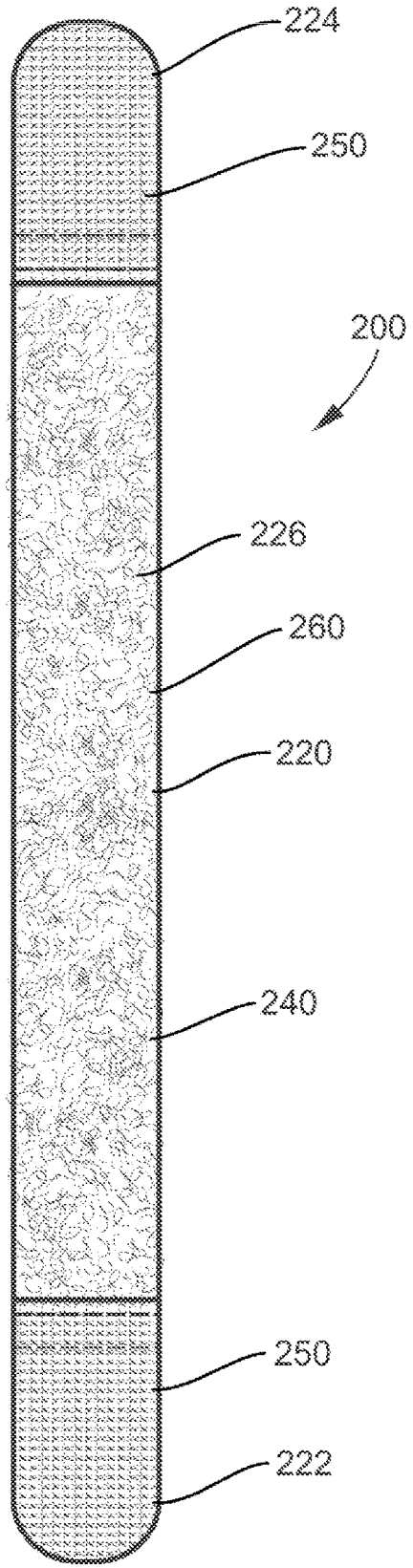
FIG. 12 a bottom view of the adjustable belt loop fastening device according to the second embodiment.

In certain aspects and as shown in FIGS. 3 and 7, a second plurality of fasteners 132 are positioned within the second end 114 of the elongate sheath 110. The second plurality of fasteners 132 extend above an outermost surface of the lower planar face 130 of the elongate sheath in a direction (D2) extending away from the device 110 and away from the first plurality of fasteners 122.

As further shown in FIG. 1, the elongate sheath 110 is configured to fold within the foldable portion 116 of the elongate sheath 110 along one or more axes (e.g., F1, F2) transverse to the longitudinal axis of the device 100 such that at least one fastener from the first plurality of fasteners 122 overlaps, aligns, and engages with at least one fastener from the second plurality of fasteners 132 such that portions of the upper 120 and lower 130 planar faces and portions of the first 112 and second 114 ends of the elongate sheath are adjacent to one another while the device is in use thereby selectively lessening the distance (D3) between belt 211, 212 loops to secure the garment's waistline 201 to the wearer while concurrently selectively minimizing force applied to an abdominal region of the wearer.

In certain aspects, each fastener of the first and second plurality fasteners are snap fit buttons configured to mate with and securely engage with one another while the device is in use as shown, for example, in FIG. 1. In other aspects, each fastener of the first and second plurality fasteners are magnets having opposite polarity in order to be attracted to one another and to securely engage one another while the device is in use as shown, for example, in FIG. 1. In other aspects, the fasteners within the first and second plurality of fasteners may be a combination of snap fit buttons and magnets (discussed immediately above). The overall number of first plurality of fasteners and second plurality of fasteners may be the same or vary as desired so long as 2 or more spaced apart fasteners are included within each of the first plurality and second plurality of fasteners thereby allowing the overall length of the device 100 to be varied by a selectively predetermined amount when the device is in use as shown, for example, in FIG. 1. This allows for the device user/wearer to selectively adjust the garment's waistline thereby securing the garment to the user with the desired amount of pressure and further minimizing force applied to an abdominal region of the wearer while the device 100 is in use and engaging belt loops 211, 212 as shown in FIG. 1.

In certain aspects and as further shown, for example, in FIG. 1, also disclosed is a method of selectively lessening the distance (D3) between a plurality of belt loops 211, 212 including (a) threading the adjustable belt loop device 100 disclosed herein between a plurality of belt loops 211, 212; and (b) engaging at least one fastener from the first plurality of fasteners 122 with at least one fastener from the second plurality of fasteners 132 such that portions of the upper 120 and lower planar 130 faces and portions of the first 112 and second 114 ends of the elongate sheath 110 are adjacent to one another and selectively lessen the distance D3 between belt loops 211, 212 and thereby secure the garment waistline to the wearer while concurrently selectively minimizing force applied to an abdominal region of the wearer. Thus, various embodiments of the adjustable belt loop fastening device and/or associated methods disclosed herein may secure the garment 190 to the wearer while reducing abdominal discomfort, especially for wearers having chronic diseases and/or illnesses (e.g., Crohn's disease, irritable bowel syndrome, colitis, etc.) that frequently result in increased abdominal sensitivity and tenderness. For example, first and second belt loops 211 and 212 may be pulled together utilizing the adjustable belt loop device 100, as disclosed herein, and secured to the respective ends of device 100 such that the garment 190 is secured to the wearer while reducing abdominal pressure applied by the garment to the wearer 190.

Figure 34:
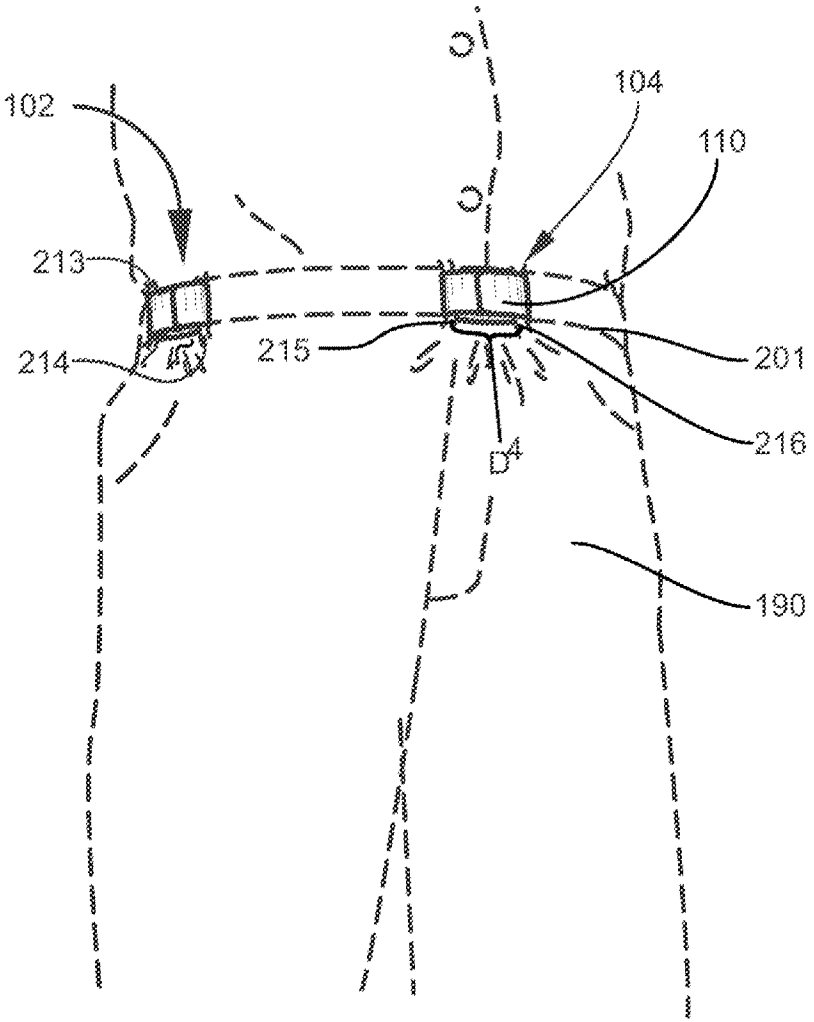
FIG. 34 is another environmental view of multiple adjustable belt loop fastening devices in use.
Figure 33:
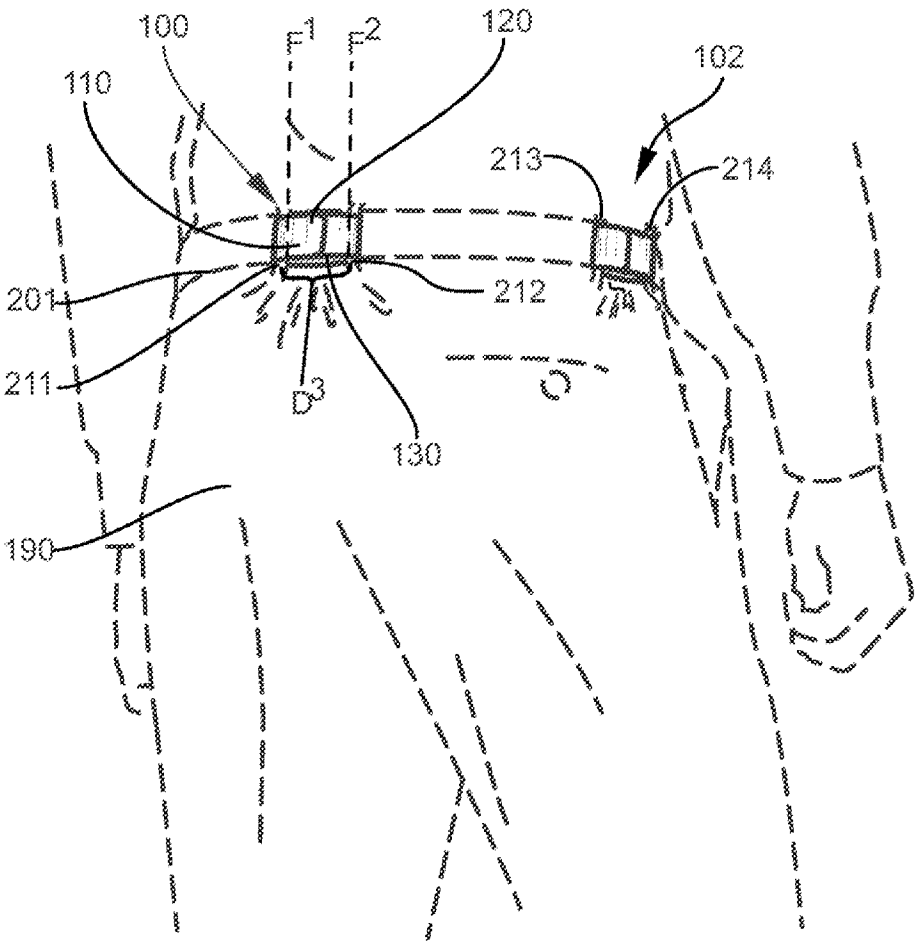
FIG. 33 is an environmental view of multiple adjustable belt loop fastening devices in use.

In certain aspects, the method may utilize a plurality of adjustable belt loop devices provided and threaded within and engaged to different pluralities of belt loops, such as different portions of the plurality of belt loops, such as different pairs of belt loops. Generally, multiple adjustable belt loop devices may allow for selectively lessen or reducing multiple portions of the garment waistline. For example and as shown in FIGS. 33 and 34, also disclosed is a method of selectively lessening the distance (D3) between the plurality of belt loops (e.g., a third belt loop 213 and a fourth belt loop 214) including (a) threading a second adjustable belt loop device 102 (e.g., another adjustable belt loop device configured the same or similar to the adjustable belt loop device 100 disclosed herein) between the plurality of belt loops 213, 214; and (b) engaging at least one fastener from the first plurality of fasteners 122 with at least one fastener from the second plurality of fasteners 132 such that portions of the upper 120 and lower planar 130 faces and portions of the first 112 and second 114 ends of the elongate sheath 110 are adjacent to one another and selectively lessen the distance D3 between belt loops 213, 214 and thereby secure the garment waistline to the wearer while concurrently selectively minimizing force applied to an abdominal region of the wearer.

Additionally or alternatively, the method may include selectively lessening the distance (D3) between the plurality of belt loops (e.g., a fifth belt loop 215 and a sixth belt loop 216) including (a) threading a third adjustable belt loop device 104 (e.g., another adjustable belt loop device configured the same or similar to the adjustable belt loop device 100 disclosed herein) between the plurality of belt loops 215, 216; and (b) engaging at least one fastener from the first plurality of fasteners 122 with at least one fastener from the second plurality of fasteners 132 such that portions of the upper 120 and lower planar 130 faces and portions of the first 112 and second 114 ends of the elongate sheath 110 are adjacent to one another and selectively lessen the distance D3 between belt loops 215, 216 and thereby secure the garment waistline to the wearer while concurrently selectively minimizing force applied to an abdominal region of the wearer.

It should be appreciated that as many adjustable belt looping devices as needed or required may be utilized to selectively reduce the distance(s) D3 between consecutive belt loops, e.g., up to and including half the number of belt loops of the garment 190. Furthermore, the adjustable belt loop fastening devices (e.g., first device 100, second device 102, a third device 104, etc.) may be utilized to reduce the distance D3 between consecutive belt loops sequentially and fully. Additionally or alternatively, multiple devices may utilized to reduce the distance D3 between consecutive belt loops by partially reducing the distance D3 between each set of belt loops in a number of iterations. Tightening the devices partially and/or in multiple rounds may maintain stylish appearance of the garment 190 and/or avoid undesirable wadding, bunching, etc. of the same.

FIGS. 9-32 depict second, third, fourth, and fifth embodiments (200, 300, 400, 500 respectively) of the adjustable belt loop fastening device(s). In particular and in view of FIGS. 9-32, disclosed are adjustable belt loop fastening devices 200, 300, 400, 500 configured to extend between and be directly affixed to a plurality of belt loops 211, 212 on a garment instead of directly on a garment waistline and, while in use and affixed to the plurality of belt loops. As shown for example in FIGS. 17, 22, 27, 32, the adjustable belt loop fastening devices 200, 300, 400, 500 selectively lessen distance between belt loops 211, 212 by gripping and applying force directly to the belt loops to bias two belts loops towards one another (indicated by black arrows) to secure the garment waistline to a wearer while, in contrast to conventional belts, concurrently selectively minimizing force applied to an abdominal region of the wearer. The adjustable belt loop fastening devices 200, 300, 400, 500 of FIGS. 9-32 each include an elongate sheath 220, 320, 420, 520 having a first end 222, 322, 422, 522, a connecting portion 226, 326, 426, 526, and a second end 224, 324, 424, 524 in which the first and second ends are each connected to but spaced apart from one another by the connecting portion 226, 326, 426, 526, positioned there between. In certain aspects, the elongate sheath comprises a woven or non-woven fabric and/or is a leather strap, which is preferably semi-rigid and is non-deformable. In this aspect, the first and second ends of the sheath may vary or be comprised of the same material as the connecting portion disclosed herein.

As further shown in FIGS. 9-32, the elongate sheath 220, 320, 420, 520 has upper planar 230, 330, 430, 530 and lower planar 240, 340, 440, 540 faces/surfaces in which fasteners are only positioned on the lower planar face 240, 340, 440, 540 in which the first 222, 322, 422, 522 and second 224, 324, 424, 524 ends of the elongate sheath are configured to wrap around (circumferentially engage) and grip separate belt loops of a wearer's garment and selectively lessen distance between the separate belt loops when the first and/or second end of the elongate sheath are advanced towards one another by gripping and applying force directly to the belt loops to bias two belts loops towards one another while the first and second ends of the elongate sheath remain substantially coplanar (shown in, for example, FIGS. 17, 22, 27, 32) relative to one another while the device is in use and affixed to the separate belt loops.

Also shown herein are sequential depictions of the adjustable belt loop fastening device in use. For example, FIGS. 13-17 sequentially depict the adjustable belt loop fastening device 200 according to the second embodiment being fastened to separate belt loops 211, 212 and securing a wearer's garment to the wearer by gripping and applying force directly to the belt loops and biasing (indicated by black arrows in FIG. 17) two belts loops towards one another. Likewise, FIGS. 20-22 sequentially depict the adjustable belt loop fastening device 300 according to the third embodiment being fastened to separate belt loops 211, 212 and securing a wearer's garment to the wearer by gripping and applying force directly to the belt loops and biasing (indicated by black arrows in FIG. 22) two belts loops towards one another. Similarly, FIGS. 25-27 sequentially depict the adjustable belt loop fastening device 400 according to the fourth embodiment being fastened to separate belt loops 211, 212 and securing a wearer's garment to the wearer by gripping and applying force directly to the belt loops and biasing (indicated by black arrows in FIG. 27) two belts loops towards one another, and FIGS. 30-32 sequentially depict the adjustable belt loop fastening device 500 according to the fifth embodiment being fastened to separate belt loops 211, 212 and securing a wearer's garment to the wearer by gripping and applying force directly to the belt loops and biasing (indicated by black arrows in FIG. 32) two belts loops towards one another The above-mentioned second 200, third 300, fourth 400, and fifth 500 embodiments disclosed herein may be used in a similar manner in a method for selectively lessening a distance between a plurality of belt loops (e.g., 211, 212). This method includes (a) threading an adjustable belt loop device 200, 300, 400, 500 disclosed herein between a plurality of belt loops 211, 212; (b) engaging and securing a first belt loop 211 within a first end of the device 222, 322, 422, 522 (e.g., wrapping a first end of the device around a belt loop and circumferentially engaging (either entirely or partially circumferentially engaging) the belt loop); and (c) applying force towards a second belt loop 212 by pulling a second end 224, 324, 424, 524 of the adjustable belt loop device 200, 300, 400, 500 in a direction opposite the first belt loop; and engaging the second end of the adjustable belt loop device to another portion of the device to selectively lessen distance between the first and second belt loops by gripping and applying force directly to the belt loops to bias the first and second belts loops towards one another while the first and second ends of an elongate sheath of the device remain substantially coplanar relative to one another while the device is in use, In view of the above methods of use, features of the second 200, third 300, fourth 400, and fifth 500 embodiments are disclosed in further detail below. Regarding the adjustable belt loop fastening device 200 shown in FIGS. 9-17, this adjustable belt loop fastening device 200 includes a first end 222, second end 224, and connecting portion 226 having hook and loop fasteners 250, 260 positioned thereon in which the first and second ends 222, 224 comprise the same hook or loop fastener 250 and the connecting portion comprises a complimentary hook or loop fastener 260 configured to securely engage the first and second ends as shown, for example, in FIG. 17 while the device 200 is in use.

In certain embodiments, and as specifically shown in FIGS. 18-32, the first and second ends of the device 300, 400, 500 comprise different fasteners. For example and in view of FIGS. 18-22, the adjustable belt loop fastening device 300 according to a third embodiment includes a first end 322 comprises snap fit buttons 370, 371 configured to securely engage one another while concurrently being affixed to and gripping one belt loop 211 while the device is in use, and the connecting portion 326 and second end 324 comprise complimentary hook and loop fasteners 350, 360 so that the second end securely engages an internal portion of the device positioned on the connecting portion 326 while concurrently being affixed to and gripping another belt loop 212 while the device is in use. In this aspect and as further shown in FIGS. 18 and 19, the first end 322 is configured to fold along a crease or crease portion 371 that extends in a direction that is transverse to the longitudinal axis of the adjustable belt loop fastening device 300.

In another embodiment, and as further shown in FIGS. 23-27, the adjustable belt loop fastening device 400 includes a first end 422 having a rigid hook 470 (formed from metal and/or a thermoplastic resin) having an internal recess 472 configured to receive and securely engage one belt loop 211 therein while the device is in use, and the connecting portion 426 and second end 424 comprise complimentary hook and loop fasteners 450, 460 so that the second end 424 securely engages the connecting portion 426 while concurrently being affixed to and gripping another belt loop 212 while the device is in use.

In yet another embodiment and as further shown in FIGS. 28-32, the adjustable belt loop fastening device 500 includes a first end 522 comprises a first and second magnet 570, 571 having opposite polarities that are embedded within the first end of the elongate sheath 520 and that are foldable 572 (e.g., along a crease or a creased portion) so that the magnets securely engage one another while the first end securely engages one belt loop 211 while the device 500 is in use, and the connecting portion 526 and second end 524 comprise complimentary hook and loop fasteners 550, 560 so that the second end 524 securely engages the connecting portion 526 while concurrently being affixed to and gripping another belt loop 212 while the device 500 is in use. In this aspect and as further shown in FIGS. 28 and 29, the first end 522 is configured to fold along a crease or crease portion 571 that extends in a direction that is transverse to the longitudinal axis of the adjustable belt loop fastening device 500.

In certain aspects, also disclosed is a kit including one or a plurality of any of the above disclosed adjustable belt loop fastening device(s) 100, 200, 300, 400, 500 and packaging with the one or plurality of adjustable belt loop fastening device(s) packaged therein.

In certain aspects, each of the adjustable belt loop fastening devices disclosed herein is limited to a length that is only sufficient to be affixed to two consecutive belt loops and pull those two consecutive belt loops towards one another for the purposes disclosed above. For instance and as illustrated particularly in FIGS. 1, 17, 22, 27, and 32-34, the adjustable belt loop fastening device (e.g., any of the above disclosed adjustable belt loop fastening device(s) 100, 102, 104, 200, 300, 400, and/or 500) may have a length defined between the first end (e.g., any of first ends 112, 222, 322, 422, or 522) and the second end (e.g., any of second ends 114, 224, 324, 424, or 524) only sufficient to affix two consecutive belt loops (e.g., first belt loop 211 and second belt loop 212, second belt loop 212 and third belt loop 213, third belt loop 214 and fourth belt loop 215, fourth belt loop 215 and a fifth belt loop 216, and so on, up to and including a last "n" belt loop (e.g., last belt loop (210+n)) and first belt loop 211) when affixed between the respective belt loops.

Figure 13:
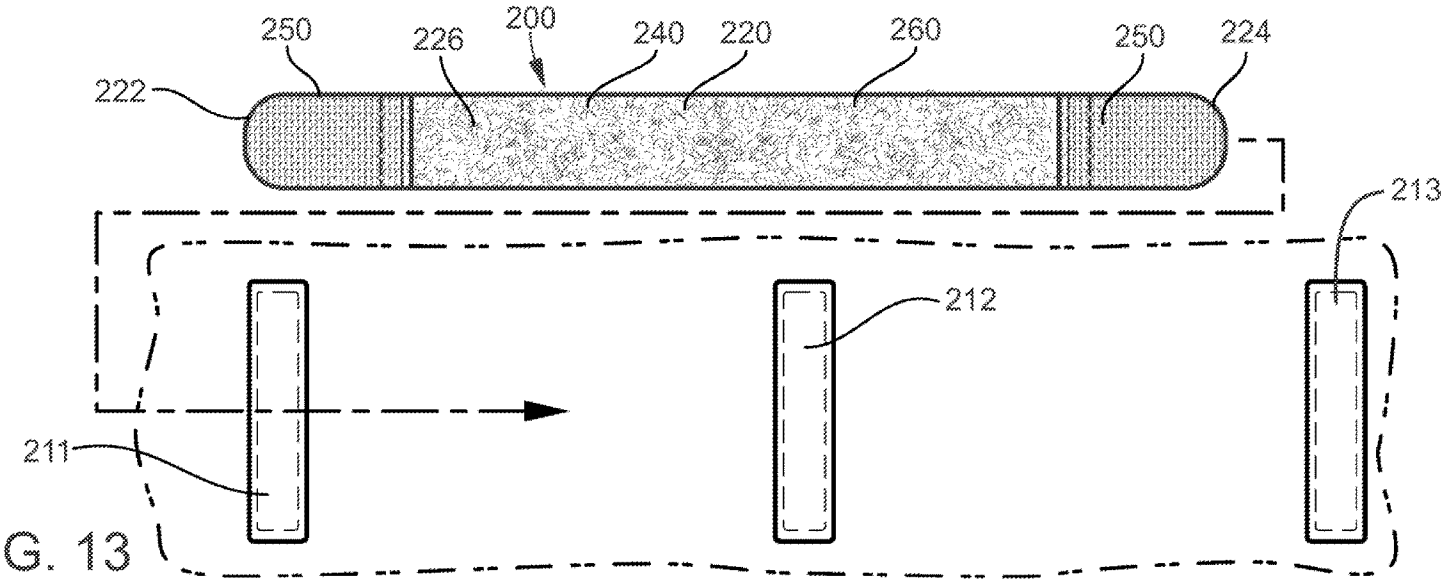
FIG. 13 depicts the adjustable belt loop fastening device according to the second embodiment before being threaded between two consecutive belt loops.
Figure 14:
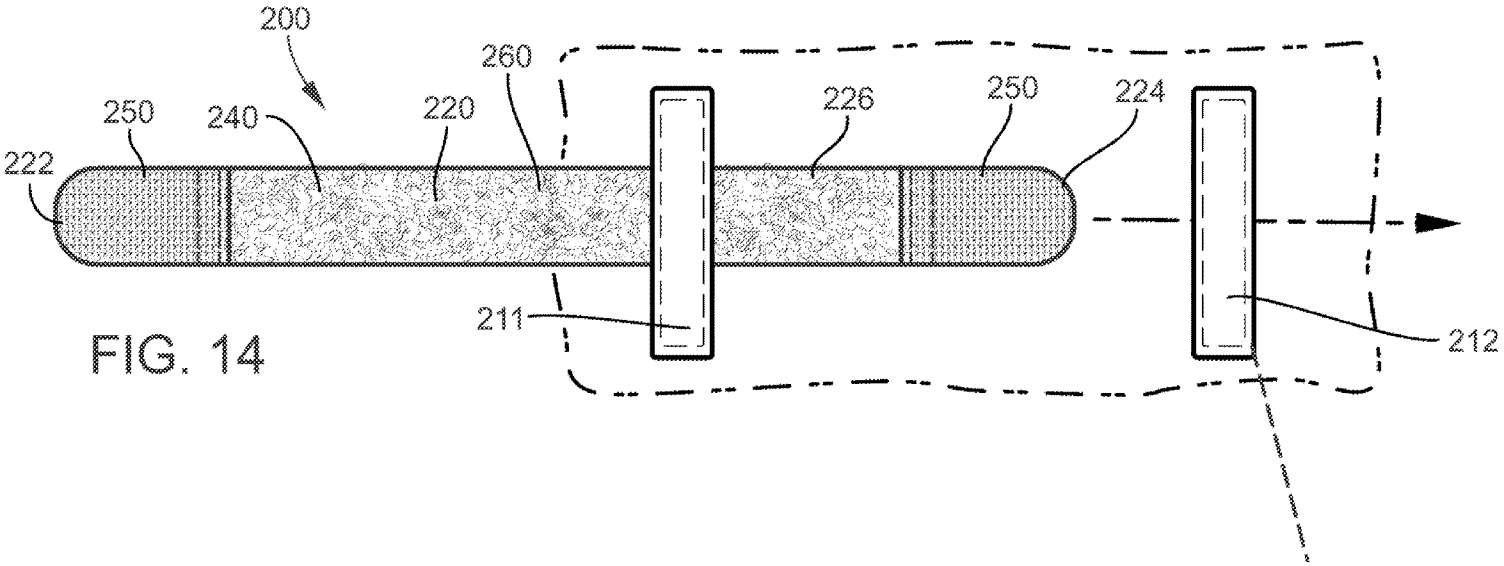
FIG. 14 depicts the adjustable belt loop fastening device according to the second embodiment being threaded into one of the two consecutive belt loops.
Figure 15:
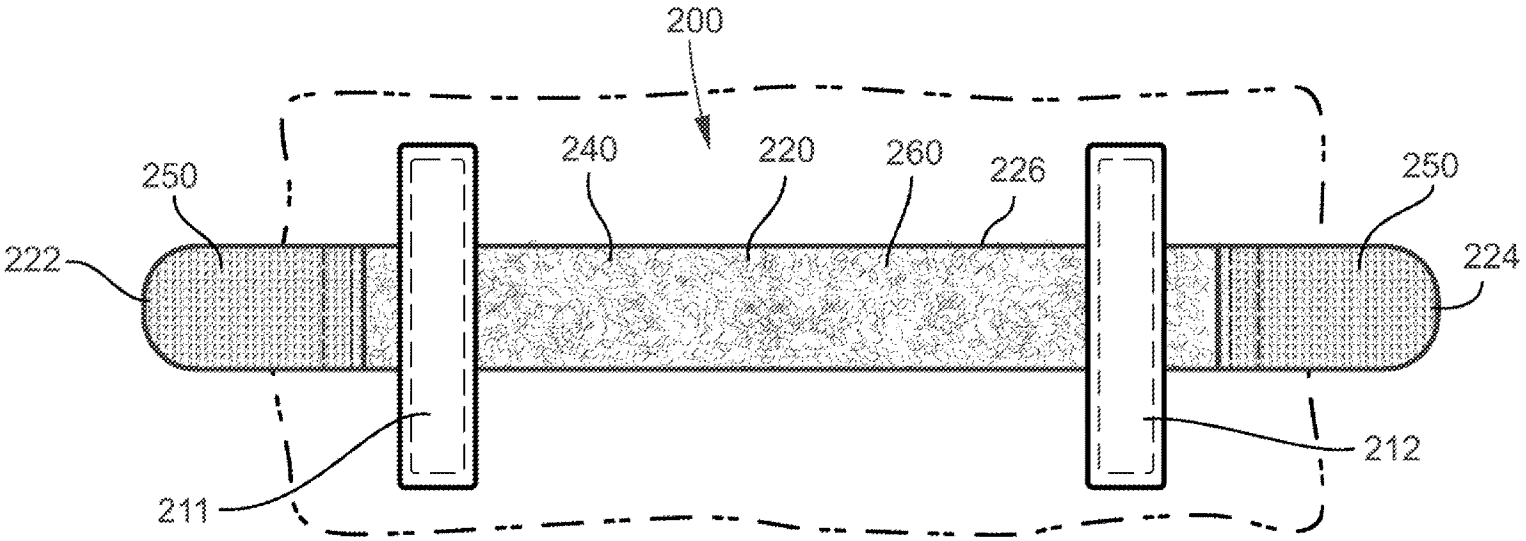
FIG. 15 depicts the adjustable belt loop fastening device according to the second embodiment being threaded into each of the two consecutive belt loops.
Figure 16:
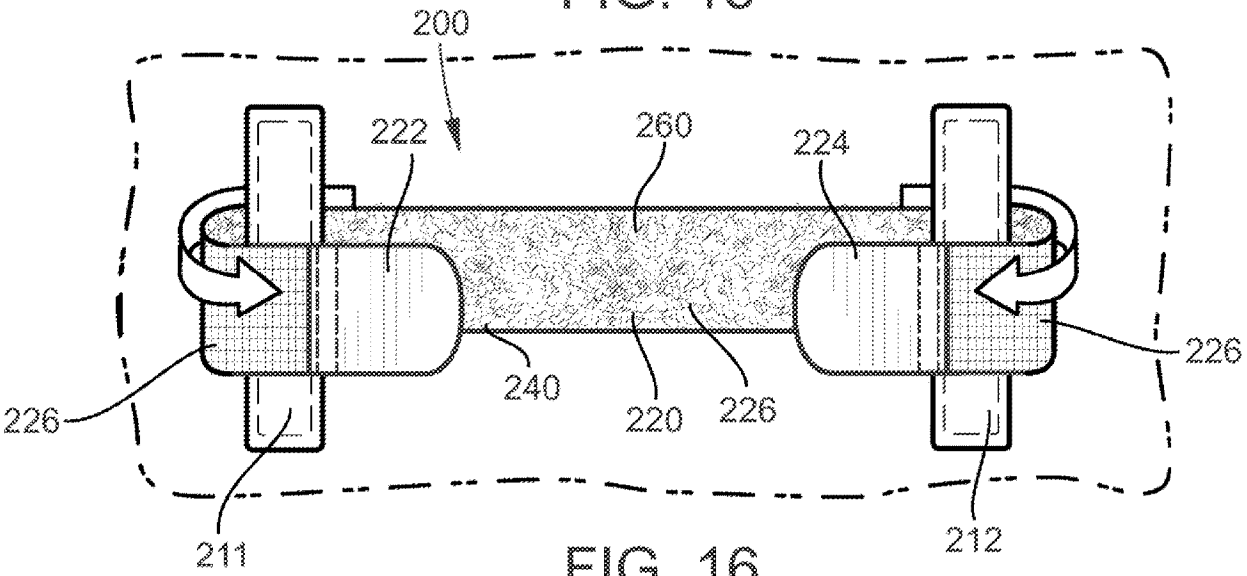
FIG. 16 depicts the end portions of the second embodiment being wrapped around and engaging each of the two consecutive belt loops in which the hook and loop fasteners positioned on the bottom of the device engage one another to affix the device to the belt loops.
Figure 17:
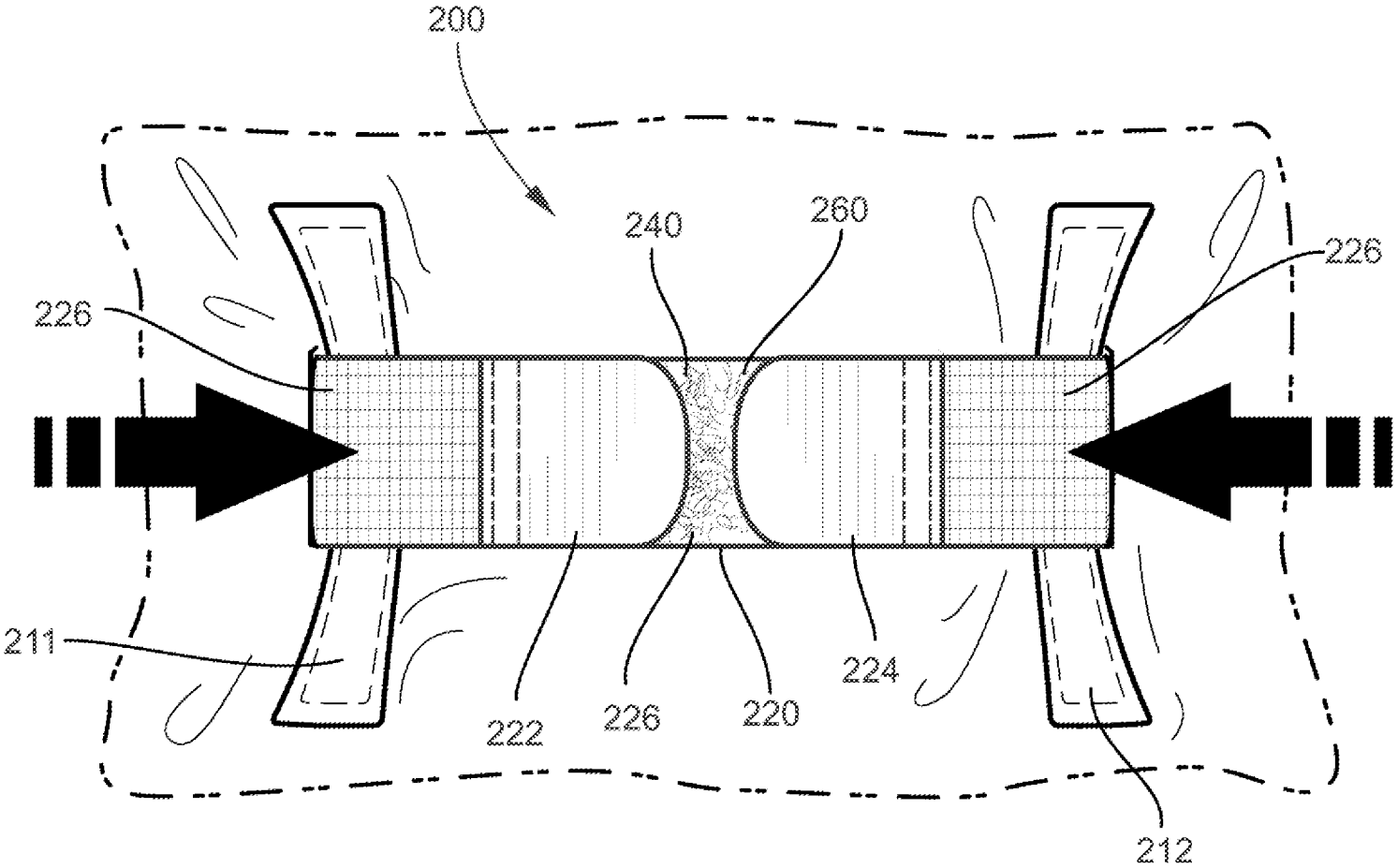
FIG. 17 depicts the end portions of the second embodiment being fully engaged to internal portions of the device to affix the device to the two consecutive belt loops and thereby decreasing the distance between the two consecutive belt loops to secure the wearer's garment to the wearer.
Figure 18:
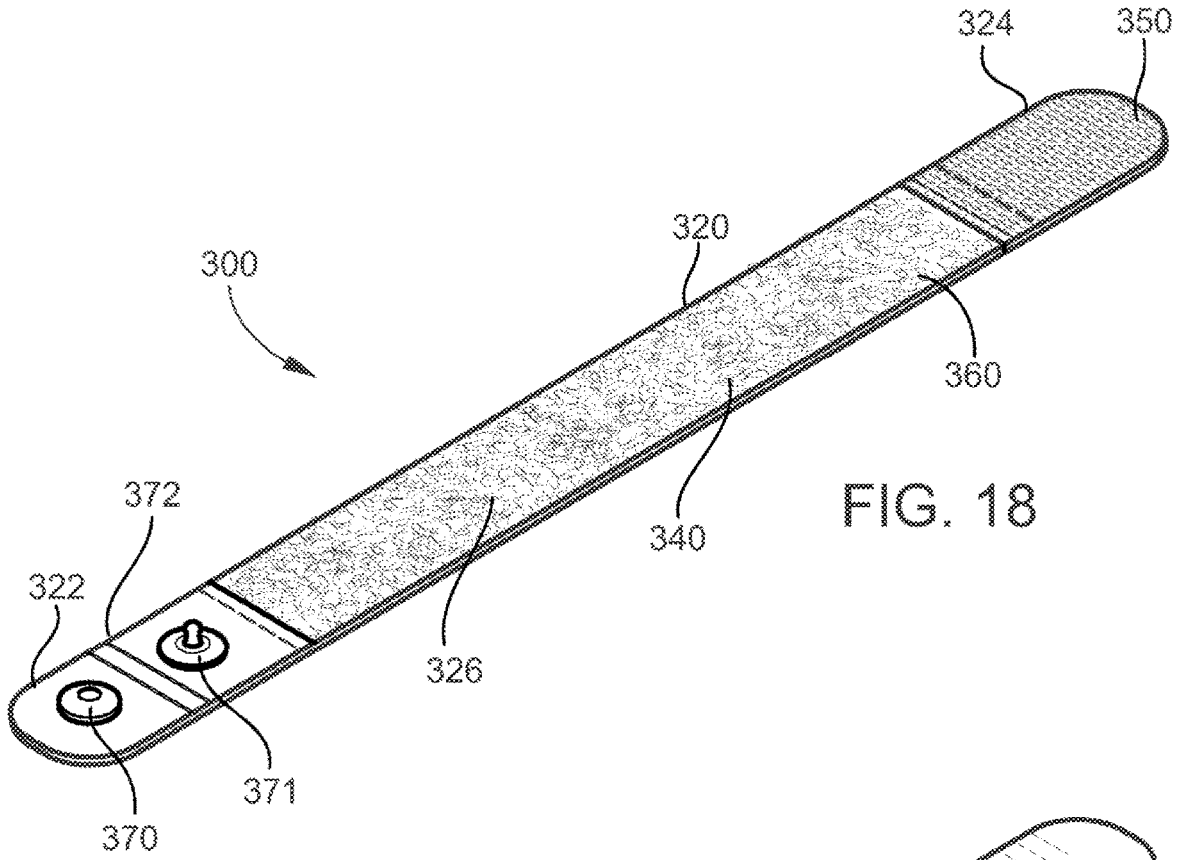
FIG. 18 is a bottom perspective view of the adjustable belt loop fastening device according to a third embodiment.
Figure 19:
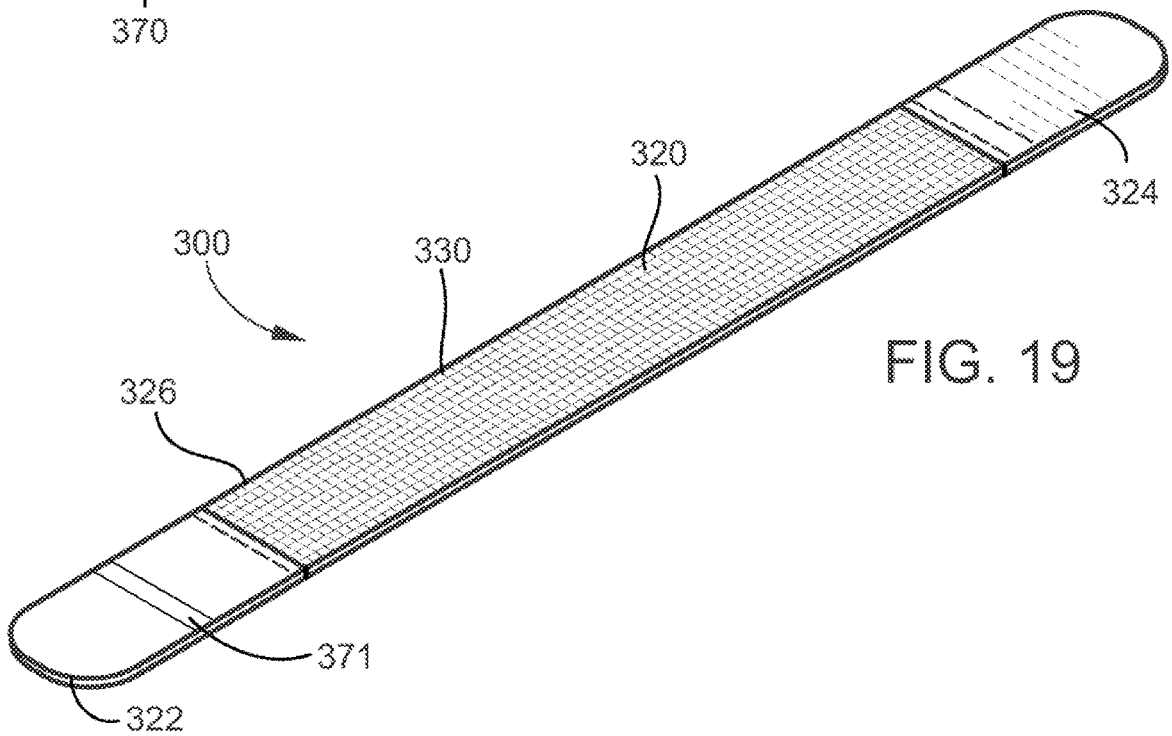
FIG. 19 is a top perspective view of the adjustable belt loop fastening device according to a third embodiment.
Figure 20:
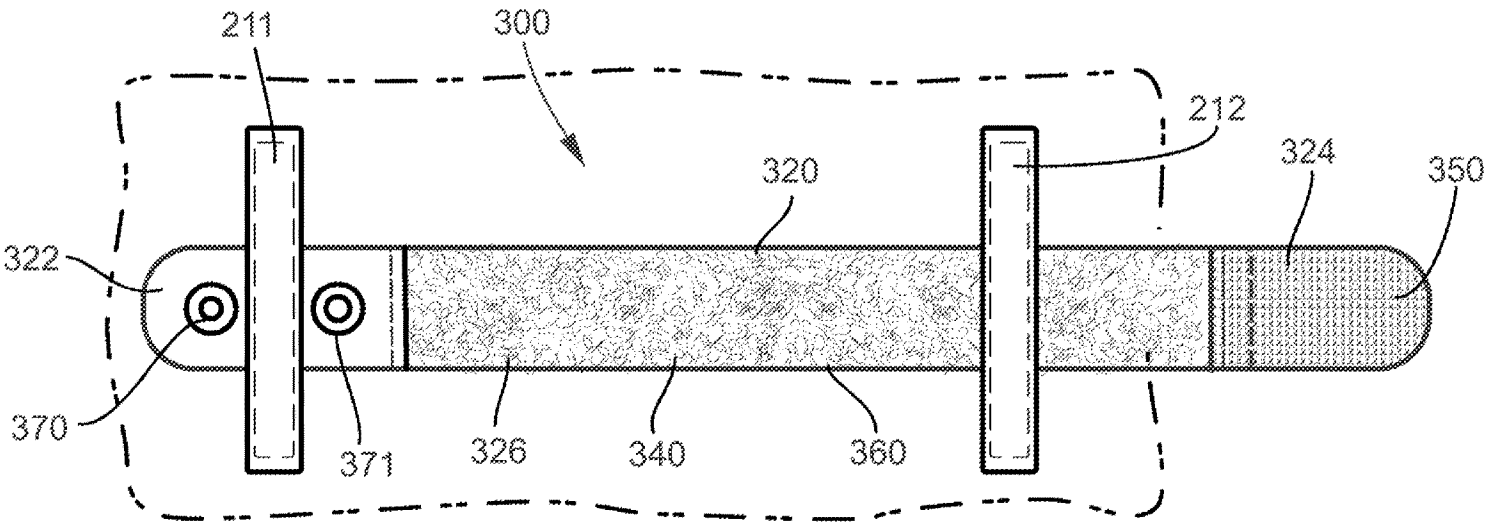
FIG. 20 depicts the adjustable belt loop fastening device according to the third embodiment being threaded into each of the two consecutive belt loops.
Figure 21:
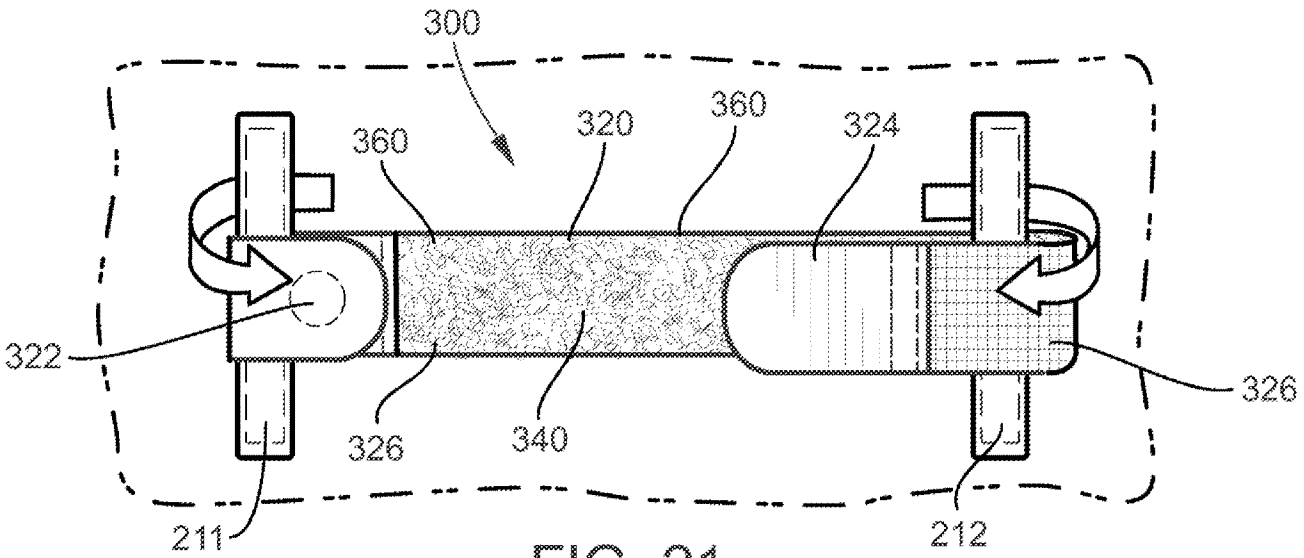
FIG. 21 depicts the end portions of the third embodiment being wrapped around and engaging each of the two consecutive belt loops in which the fasteners are positioned only on the bottom of the device and engage one another when affixing the device to the belt loops.
Figure 22:
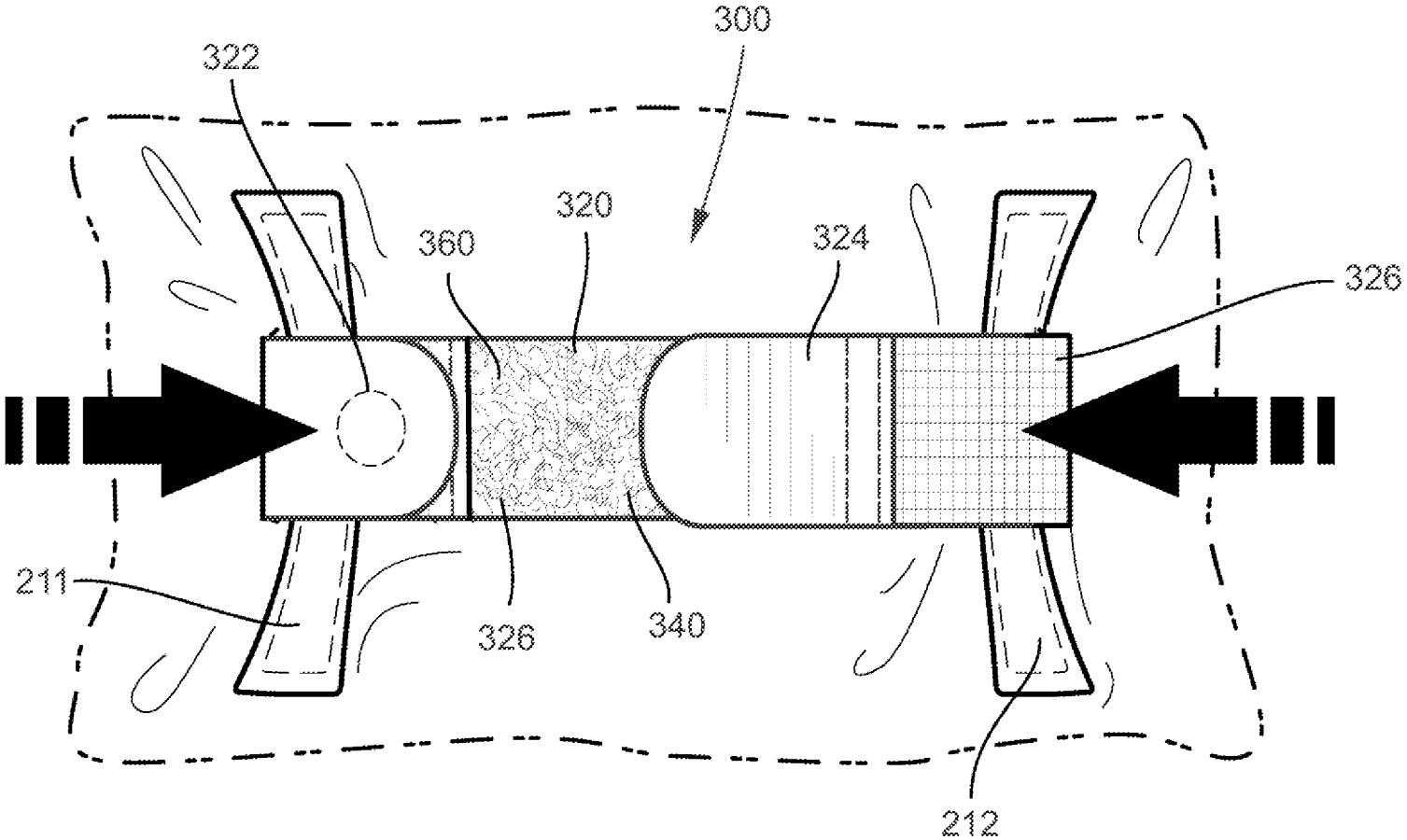
FIG. 22 depicts the end portions of the third embodiment being fully engaged to internal portions of the device to affix the device to the two consecutive belt loops and thereby decreasing the distance between the two consecutive belt loops to secure the wearer's garment to the wearer.
Figure 23:
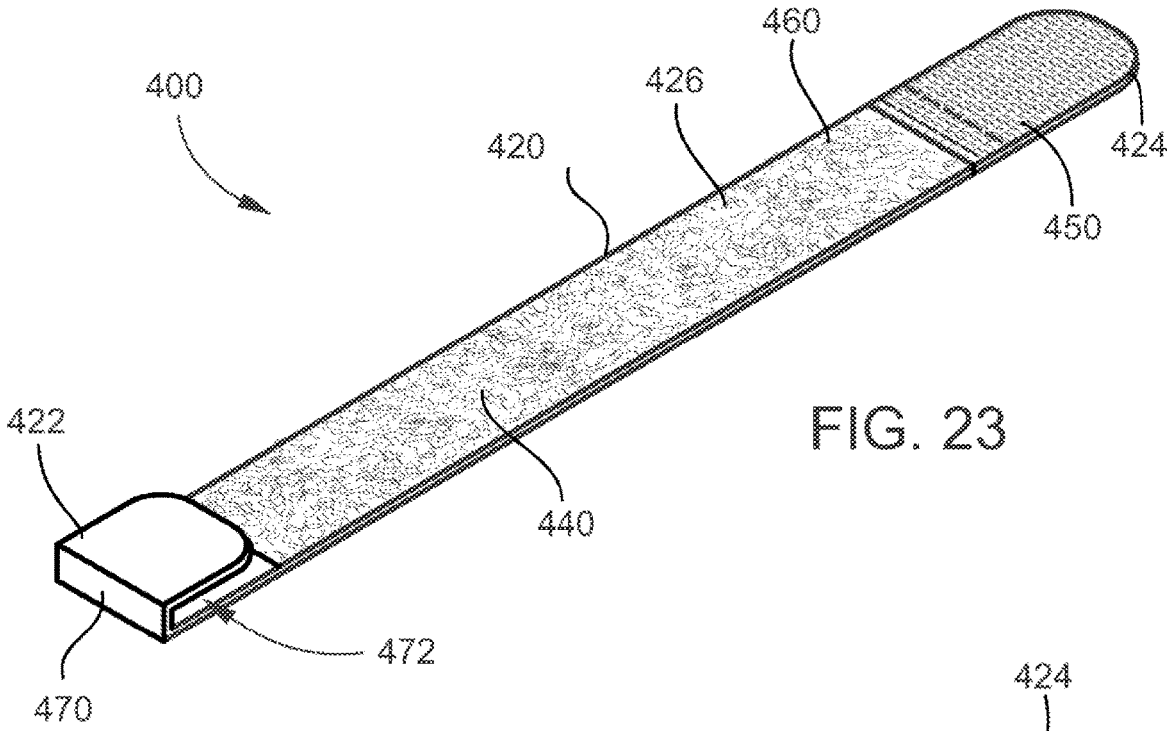
FIG. 23 is a bottom perspective view of the adjustable belt loop fastening device according to a fourth embodiment.
Figure 24:
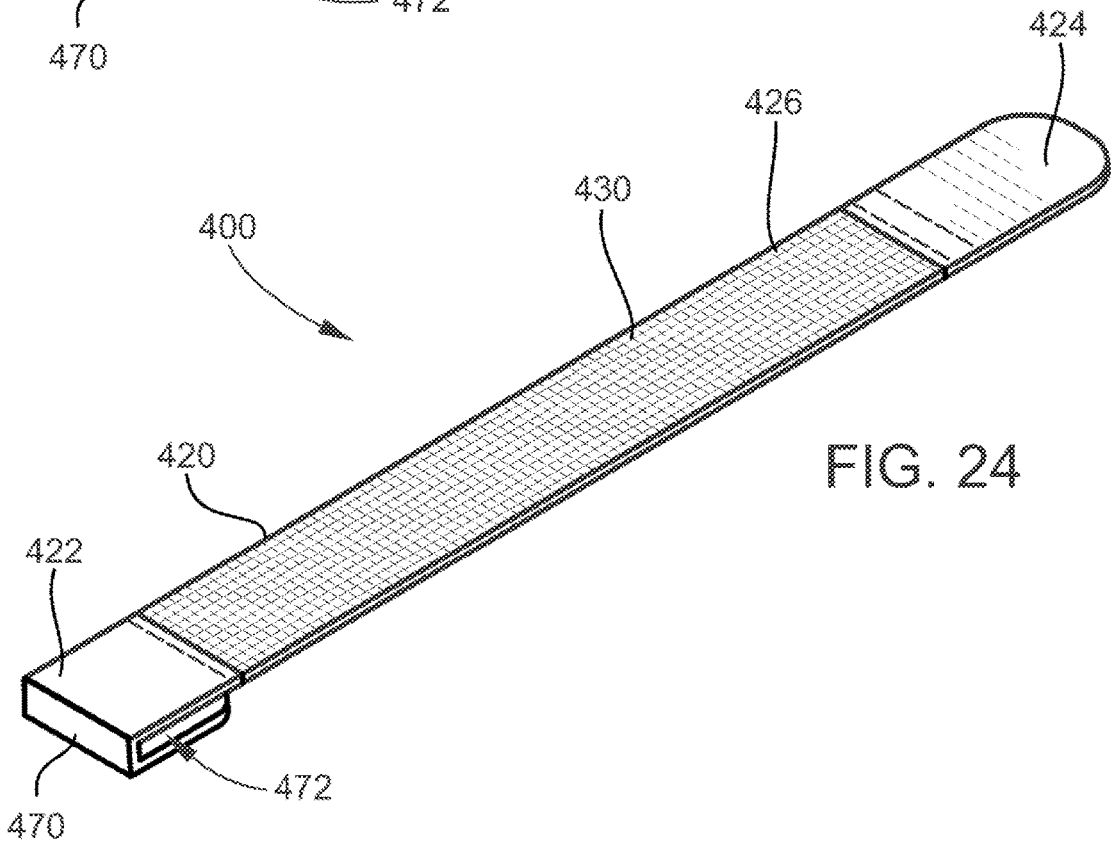
FIG. 24 is a top perspective view of the adjustable belt loop fastening device according to a fourth embodiment.
Figure 25:
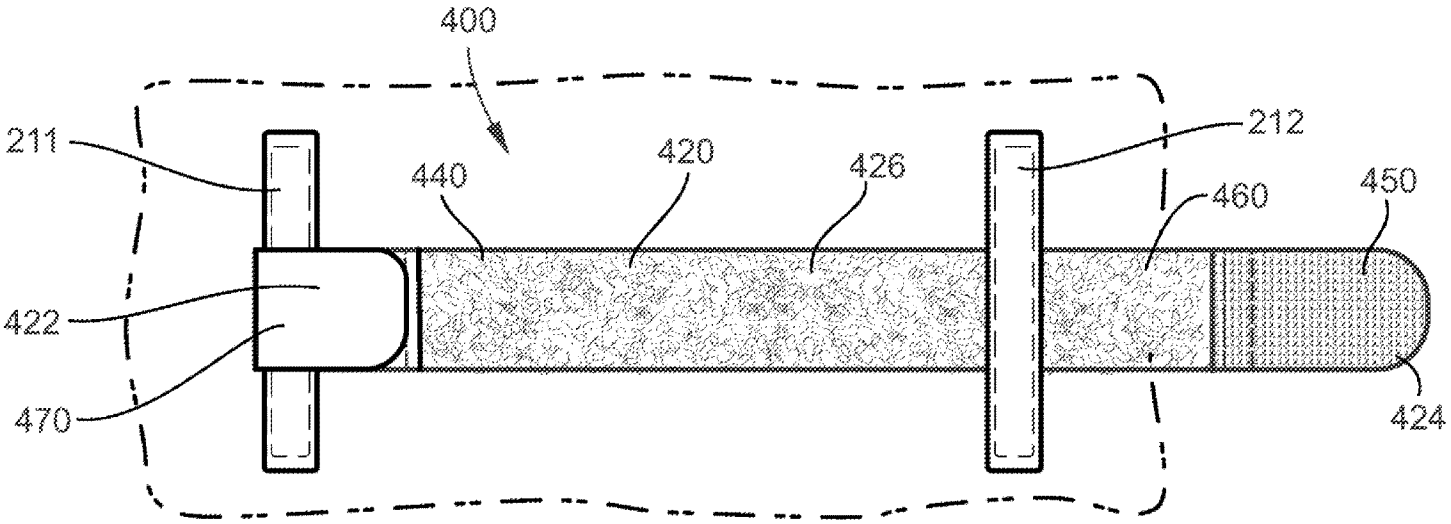
FIG. 25 depicts the adjustable belt loop fastening device according to the fourth embodiment being threaded into each of the two consecutive belt loops and with a rigid hook positioned on one end of device being affixed to a belt loop.
Figure 26:
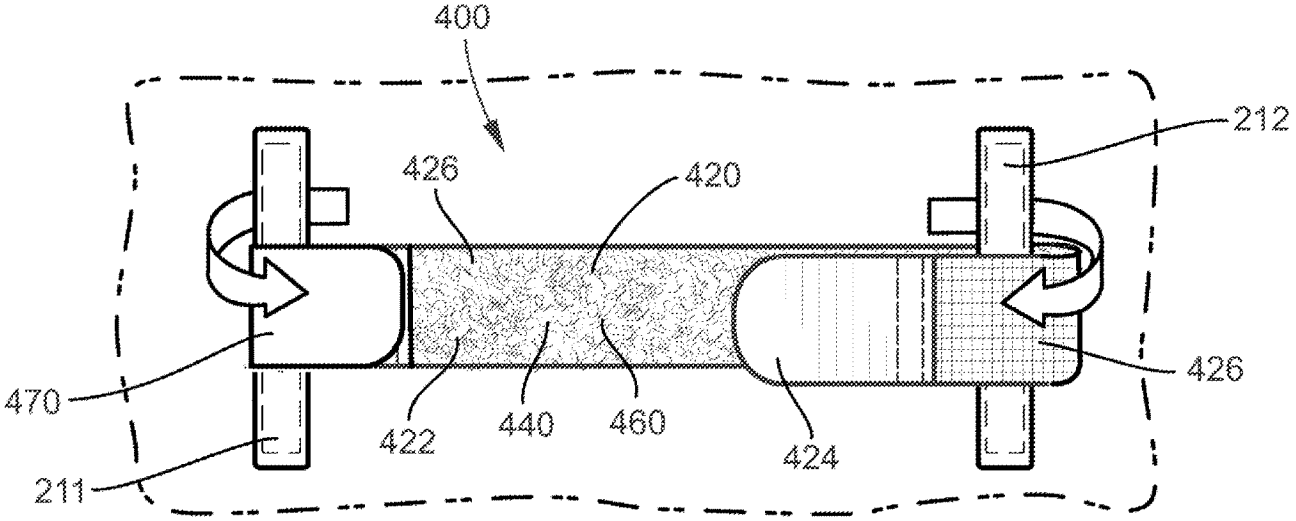
FIG. 26 depicts the second end of the adjustable belt loop fastening device according to the fourth embodiment being wrapped around and engaging the second belt loop.
Figure 27:
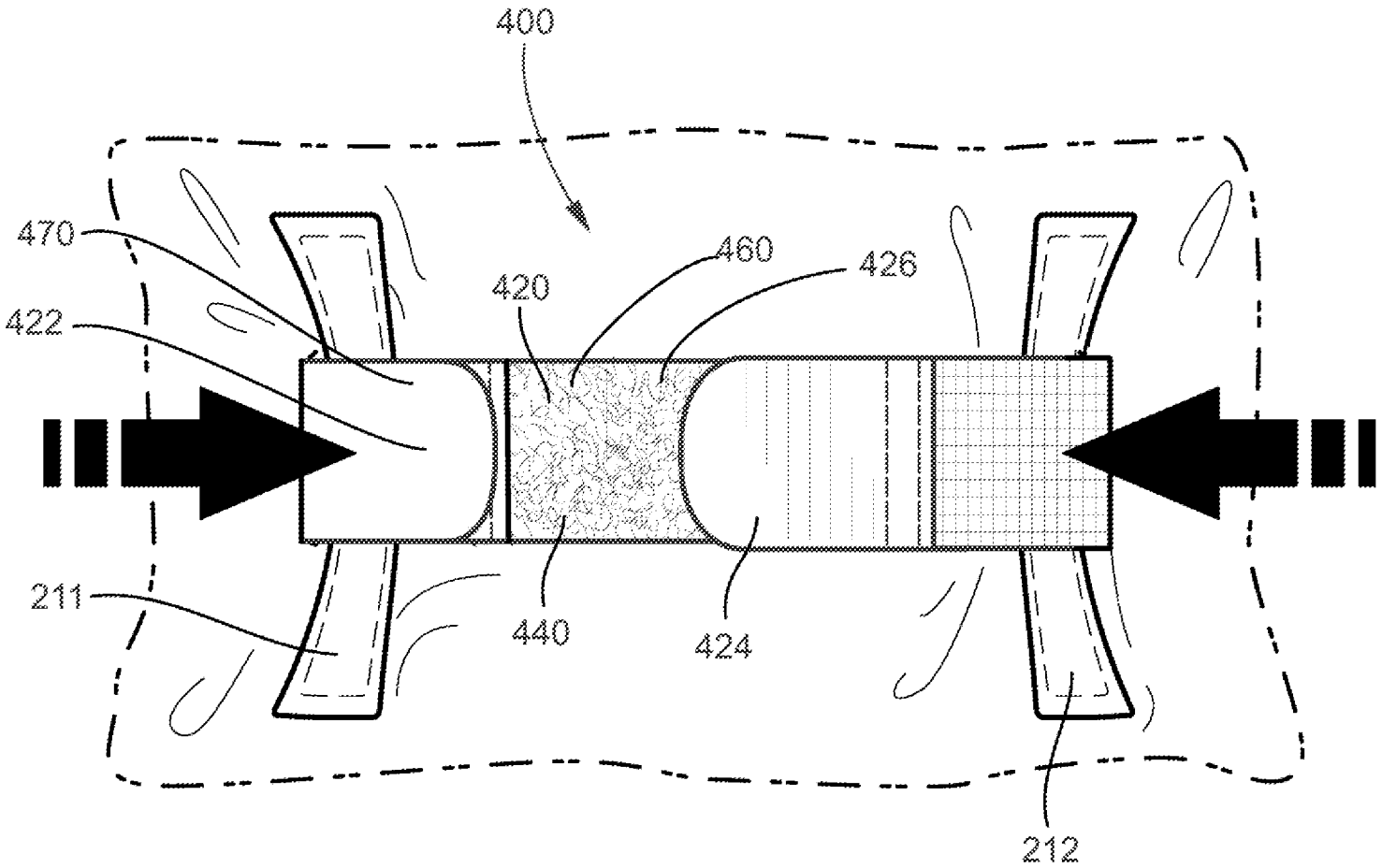
FIG. 27 depicts the end portions of the fourth embodiment being fully engaged to and affixing the device to the two consecutive belt loops and thereby decreasing the distance between the two consecutive belt loops to secure the wearer's garment to the wearer.
Figure 28:
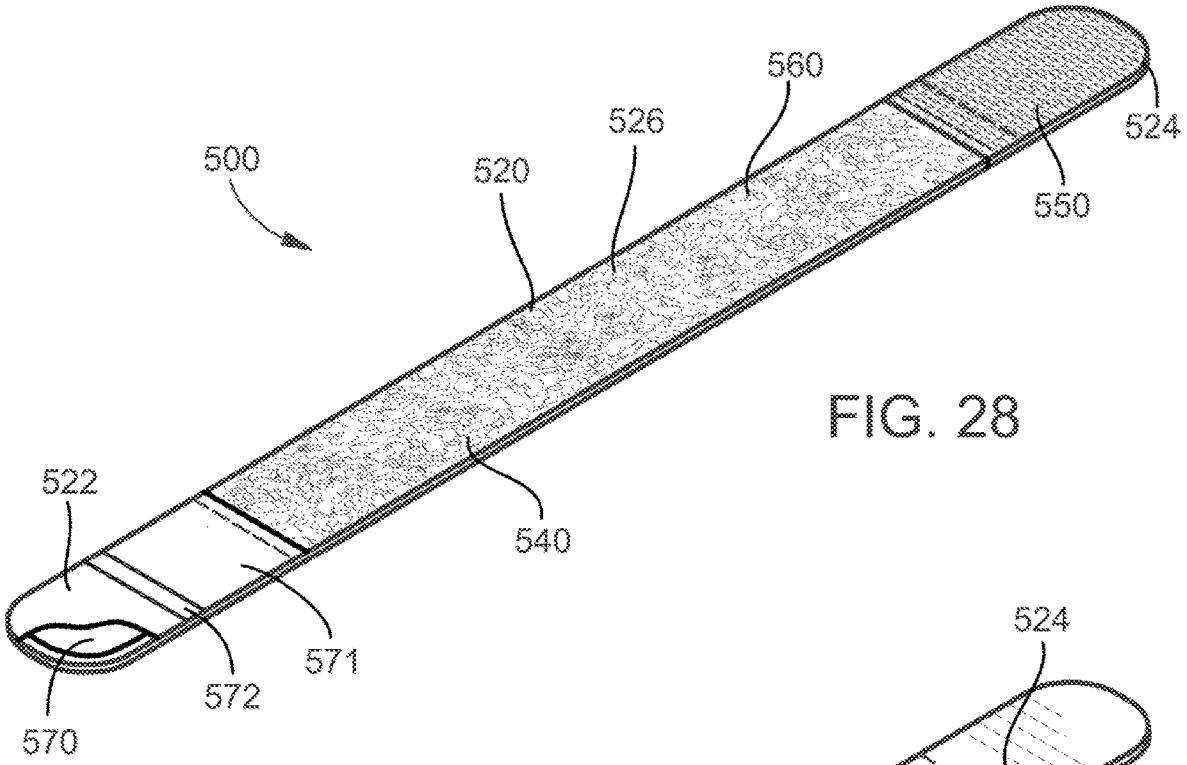
FIG. 28 is a bottom perspective view of the adjustable belt loop fastening device according to a fifth embodiment.
Figure 29:
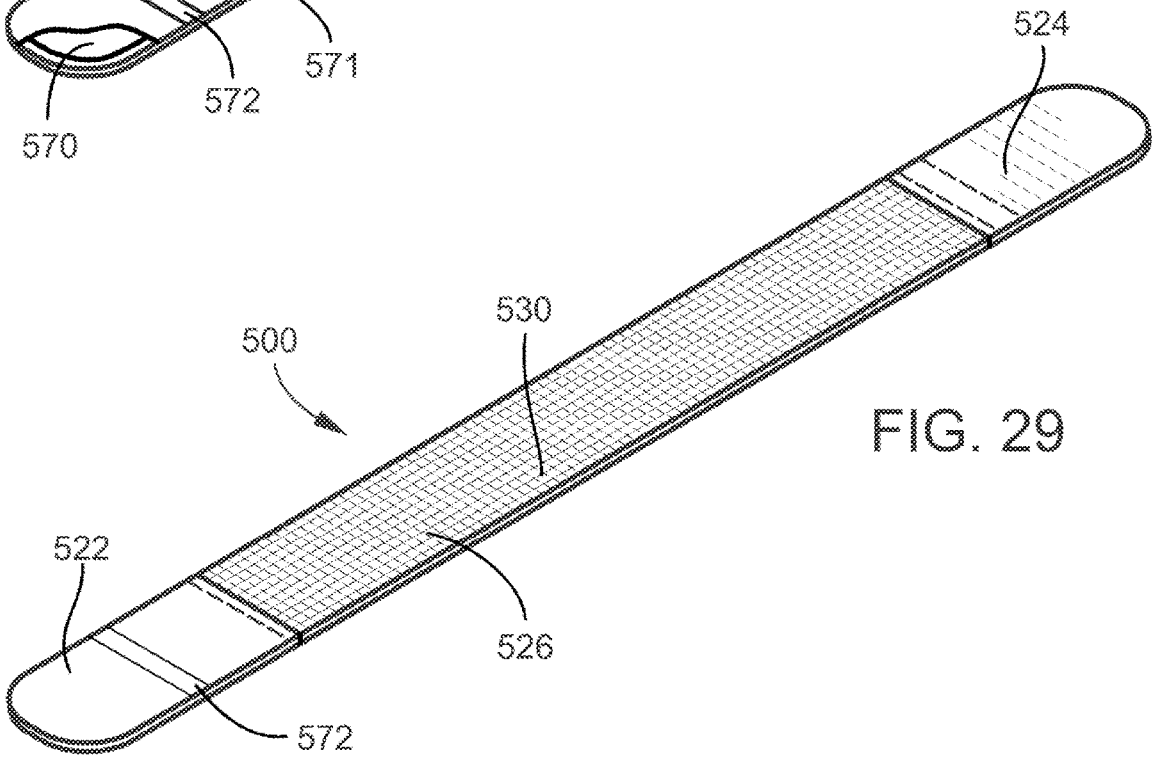
FIG. 29 is a top perspective view of the adjustable belt loop fastening device according to a fifth embodiment.
Figure 30:
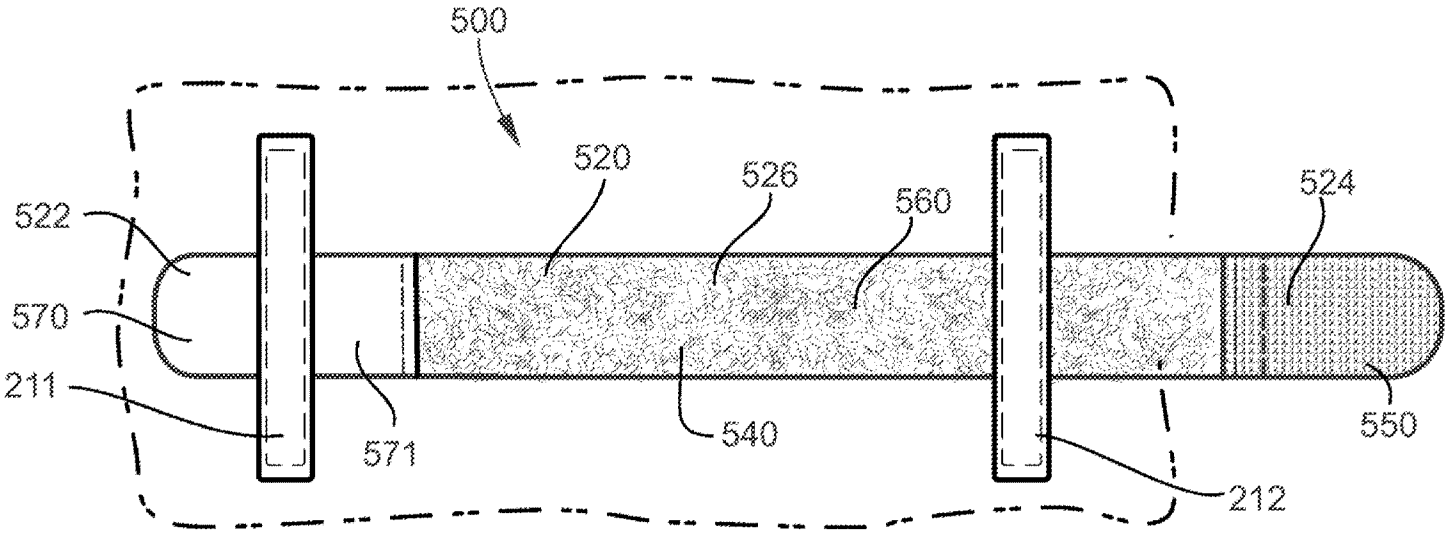
FIG. 30 depicts the adjustable belt loop fastening device according to the fifth embodiment being threaded into each of the two consecutive belt loops.
Figure 31:
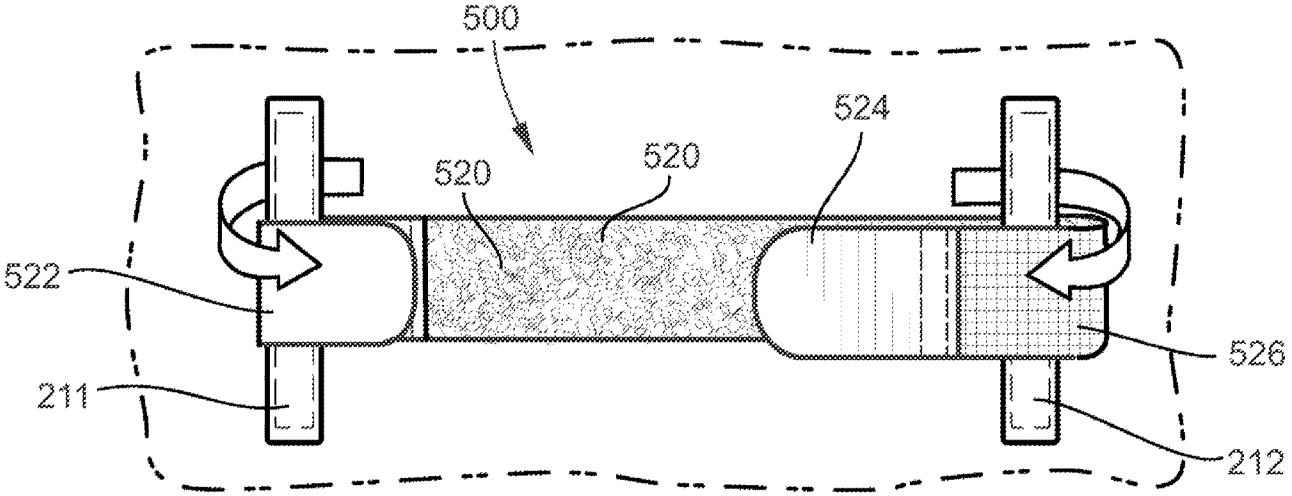
FIG. 31 depicts the end portions of the fifth embodiment being wrapped around and engaging each of the two consecutive belt loops in which the fasteners are positioned only on the bottom of the device and engage one another when affixing the device to the belt loops.
Figure 32:
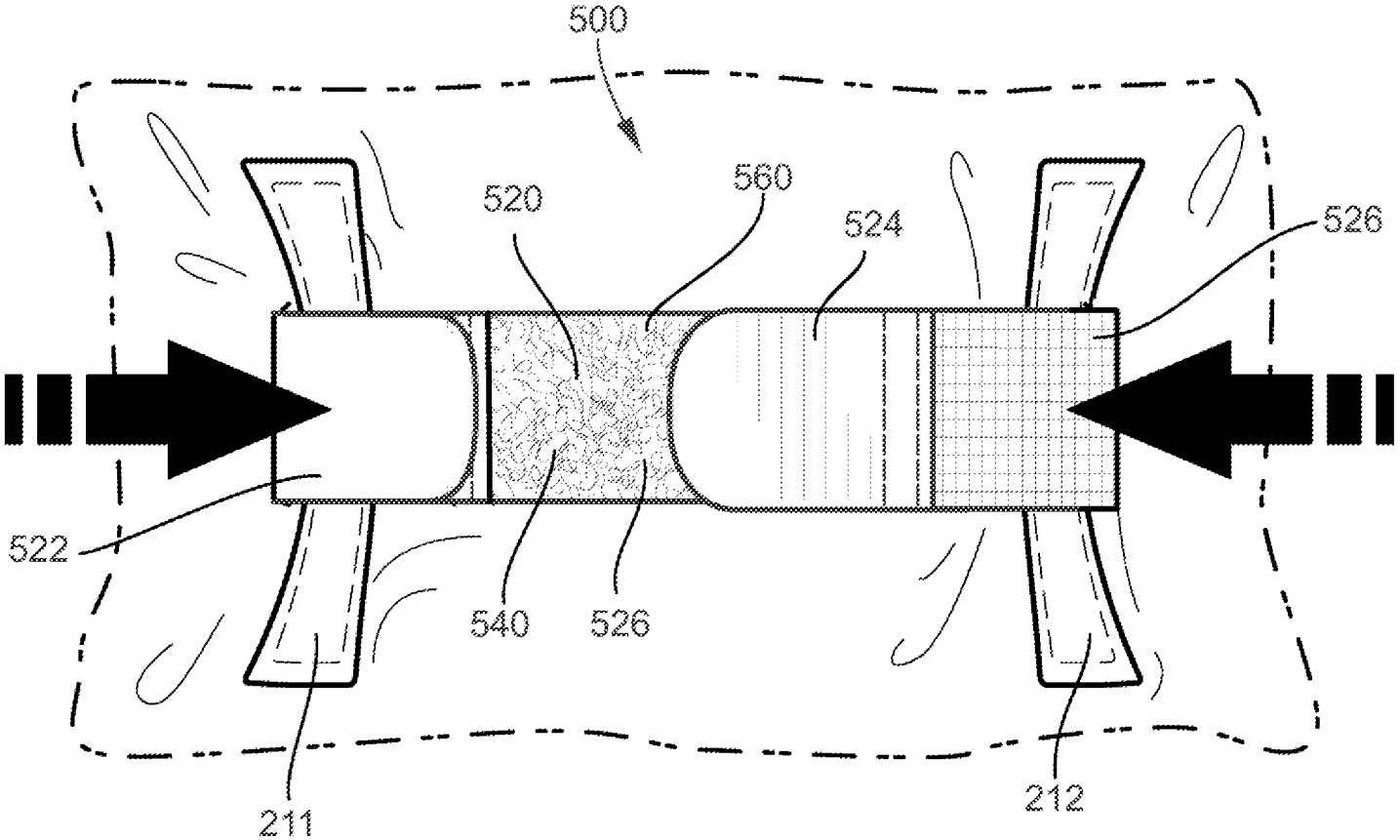
FIG. 32 depicts the end portions of the fifth embodiment being fully engaged to and affixing the device to the two consecutive belt loops and thereby decreasing the distance between the two consecutive belt loops to secure the wearer's garment to the wearer.

Referring now particularly to the exemplary embodiment of FIG. 13 and in some embodiments, the adjustable belt loop fastening device (e.g., device 200) may define a length between the first end (e.g., first end 222) and the second end (e.g., second end 224) that is greater than a distance between a first consecutive belt loop (e.g., first belt loop 211) and a second belt loop (e.g., second belt loop 212). Thus and a shown FIG. 13, the length of the adjustable belt loop fastening device 200 in the open and/or unfolded position may be longer than a distance between the first loop 211 and the second loop 212. Additionally or alternatively, the length of the adjustable belt loop fastening device 200 in the open and/or unfolded position and threaded through the belt loops may be shorter than a distance between the first consecutive belt loop (e.g., the first loop 211) and the third consecutive belt loop (e.g., third loop 213). While a third belt loop 213 is excluded from FIGS. 20, 25, 30, it should be appreciated that other adjustable belt loop fastening devices (e.g., any of the above disclosed adjustable belt loop fastening device(s) 100, 102, 104, 300, 400, 500, and/or similarly or suitably configured adjustable belt loop fastening devices) may also define an open or unfolded length greater than the distance between the first consecutive belt loop (e.g., loop 211) and the second consecutive belt loop (e.g., loop 212) and/or may define an open or unfolded length less than the distance between the first consecutive belt loop and the third consecutive belt loop (e.g., third loop 213).

Particular embodiments and features have been described with reference to the drawings. It is to be understood that these descriptions are not limited to any single embodiment or any particular set of features. Similar embodiments and features may arise or modifications and additions may be made without departing from the scope of these descriptions and the spirit of the appended claims. The foregoing description provides embodiments of the invention by way of example only. It is envisioned that other embodiments may perform similar functions and/or achieve similar results. Any and all such equivalent embodiments and examples are within the scope of the present invention and are intended to be covered by the appended claims.

What is claimed is:

1. A method of securing a garment to a wearer while selectively reducing abdominal discomfort, the method comprising:

(a) threading an adjustable belt loop fastening device between a plurality of belt loops;

(b) engaging and securing a first belt loop within a first end of the device; and (c) applying force towards a second belt loop by pulling a second end of the adjustable belt loop fastening device in a direction opposite the first belt loop; and (d) engaging the second end of the adjustable belt loop fastening device to another portion of the device to selectively lessen distance between the first and second belt loops by gripping and applying force directly to the belt loops to bias the first and second belts loops towards one another while the first and second ends of an elongate sheath of the device remain substantially coplanar relative to one another while the device is in use such that the garment is secured to the wearer while the abdominal pressure applied by the garment to the wearer, wherein the adjustable belt loop fastening device comprises the elongate sheath having the first end, the second end, and a connecting portion, in which the first and second ends are each connected to but spaced apart from one another by the connecting portion positioned there between, the elongate sheath having upper planar and lower planar faces, and in which fasteners are only positioned on the lower planar face and in which the first and second ends of the elongate sheath are configured to wrap around and grip separate belt loops of a wearer's garment to selectively lessen distance between the separate belt loops when the first end and/or the second end of the elongate sheath are advanced towards one another and fastened on the device, and wherein the first end, the second end, and the connecting portion comprise hook and loop fasteners positioned thereon, in which the first and second ends comprise the same hook fastener or loop fastener and the connecting portion comprises a complimentary hook fastener or loop fastener configured to securely engage the first and second ends while the device is in use, the hook and loop fasteners continuously arranged on the device such that the hook and loop fasteners directly contact one another when the adjustable belt loop fastening device is in use and when the device is completely open in a flat position.

2. The method of claim 1, wherein the elongate sheath has a length defined between the first end and the second end, the length configured to only extend a distance between a first consecutive belt loop and second consecutive belt loop of the plurality of belt loops when affixed to the plurality of belt loops.

3. The method of claim 1, wherein the elongate sheath has a length defined between the first end and the second end, the length configured to be less than a distance between a first consecutive belt loop and a third consecutive belt loop of the plurality of belt loops when threaded through the plurality of belt loops.

4. The method of claim 1, further comprising:

(e) threading a second adjustable belt loop fastening device between the plurality of belt loops;

(f) engaging and securing a third belt loop within a first end of the second device;

(g) applying force towards a fourth belt loop by pulling a second end of the second adjustable belt loop fastening device in a direction opposite the third belt loop; and (h) engaging the second end of the second adjustable belt loop fastening device to another portion of the second device to selectively lessen distance between the third and fourth belt loops by gripping and applying force directly to the belt loops to bias the third and fourth belt loops towards one another while the first and second ends of an elongate sheath of the second device remain substantially coplanar relative to one another while the second device is in use such that the garment is secured to the wearer while reducing the abdominal pressure applied by the garment to the wearer, wherein the second adjustable belt loop fastening device is configured the same as the adjustable belt loop fastening device.

5. The method of claim 4, further comprising:

(i) threading a third adjustable belt loop fastening device between the plurality of belt loops;

(j) engaging and securing a fifth belt loop within a first end of the third device;

(k) applying force towards a sixth belt loop by pulling a second end of the third adjustable belt loop fastening device in a direction opposite the fifth belt loop; and (l) engaging the second end of the third adjustable belt loop fastening device to another portion of the third device to selectively lessen distance between the fifth and sixth belt loops by gripping and applying force directly to the belt loops to bias the fifth and sixth belt loops towards one another while the first and second ends of an elongate sheath of the third device remain substantially coplanar relative to one another while the third device is in use such that the garment is secured to the wearer while reducing the abdominal pressure applied by the garment to the wearer, wherein the third adjustable belt loop fastening device is configured the same as the adjustable belt loop fastening device.

6. The method of claim 1, wherein the elongate sheath is a semi-rigid material.

7. The method of claim 1, wherein the elongate sheath is a non-deformable material.

8. The method of claim 1, wherein the elongate sheath is a semi-rigid and non-deformable material.

9. The method of claim 1, wherein the elongate sheath comprises one of a woven fabric, a non-woven fabric, or a leather strap.

10. A method of securing a garment to a wearer while selectively reducing abdominal discomfort, the method comprising:

(a) threading an adjustable belt loop fastening device disclosed herein between a plurality of belt loops;

(b) engaging and securing a first belt loop within a first end of the device;

(c) applying force towards a second belt loop by pulling a second end of the adjustable belt loop fastening device in a direction opposite the first belt loop; and (d) engaging the second end of the adjustable belt loop fastening device to another portion of the device to selectively lessen distance between the first and second belt loops by gripping and applying force directly to the belt loops to bias the first and second belts loops towards one another while the first and second ends of an elongate sheath of the device remain substantially coplanar relative to one another while the device is in use such that the garment is secured to the wearer while reducing the abdominal pressure applied by the garment to the wearer, and wherein the adjustable belt loop fastening device comprises the elongate sheath having the first end, the second end, and a connecting portion, in which the first and second ends are each connected to but spaced apart from one another by the connecting portion positioned there between, the elongate sheath having upper planar and lower planar faces, and in which fasteners are only positioned on the lower planar face and in which the first and second ends of the elongate sheath are configured to wrap around and grip separate belt loops of a wearer's garment to selectively lessen distance between the separate belt loops when the first end and/or the second end of the elongate sheath are advanced towards one another and fastened on the device, and wherein the first and second ends comprise different fasteners, the first end configured to securely engage one belt loop of the belt loops while the device is in use, and the connecting portion and the second end comprising complimentary hook and loop fasteners so that the second end securely engages the connecting portion while concurrently being affixed to and gripping another belt loop while the device is in use, the hook and loop fasteners continuously arranged on the device such that the hook and loop fasteners directly contact one another when the adjustable belt loop fastening device is in use and when the device is completely open in a flat position.

11. The method of claim 10, wherein the first end comprises snap fit buttons configured to securely engage one another while concurrently being affixed to and gripping the one belt loop of the belt loops while the device is in use.

12. The method of claim 11, wherein the elongate sheath has a length defined between the first end and the second end, the length configured to only extend a distance between a first consecutive belt loop and second consecutive belt loop of the plurality of belt loops when affixed to the plurality of belt loops.

13. The method of claim 11, wherein the elongate sheath has a length defined between the first end and the second end, the length configured to be less than a distance between a first consecutive belt loop and a third consecutive belt loop of the plurality of belt loops when threaded through the plurality of belt loops.

14. The method of claim 10, wherein the first end comprises a rigid hook permanently affixed thereto having an internal recess configured to receive and securely engage the one belt loop of the belt loops therein while the device is in use.

15. The method of claim 14, wherein the elongate sheath has a length defined between the first end and the second end, the length configured to only extend a distance between a first consecutive belt loop and second consecutive belt loop of the plurality of belt loops when affixed to the plurality of belt loops.

16. The method of claim 14, wherein the elongate sheath has a length defined between the first end and the second end, the length configured to be less than a distance between a first consecutive belt loop and a third consecutive belt loop of the plurality of belt loops when threaded through the plurality of belt loops.

17. The method of claim 10, wherein the first end comprises a first magnet and second magnet having opposite polarities that are embedded within the first end of the elongate sheath and that are foldable so that the magnets securely engage one another while the first end securely engages the one belt loop of the belt loops therein while the device is in use.

18. The method of claim 17, wherein the elongate sheath has a length defined between the first end and the second end, the length configured to only extend a distance between a first consecutive belt loop and second consecutive belt loop of the plurality of belt loops when affixed to the plurality of belt loops.

19. The method of claim 17, wherein the elongate sheath has a length defined between the first end and the second end, the length configured to be less than a distance between a first consecutive belt loop and a third consecutive belt loop of the plurality of belt loops when threaded through the plurality of belt loops.

20. An adjustable belt loop fastening device configured to extend between and be directly affixed to a plurality of belt loops on a garment instead of directly on a garment waistline and, while in use and affixed to the plurality of belt loops, to selectively lessen distance between the belt loops by gripping and applying force directly to the belt loops to bias two belts loops towards one another to secure the garment waistline to a wearer while concurrently selectively minimizing force applied to an abdominal region of the wearer, the adjustable belt loop fastening device comprising:

an elongate sheath having a first end, a connecting portion, and a second end in which the first and second ends are each connected to but spaced apart from one another by the connecting portion positioned there between, the elongate sheath having a length defined between the first end and the second end, the length configured to be less than a distance between a first consecutive belt loop and a third consecutive belt loop of the plurality of belt loops, wherein the elongate sheath has upper planar and lower planar faces in which fasteners are only positioned on the lower planar face and in which the first and second ends of the elongate sheath are configured to wrap around and grip separate belt loops of a wearer's garment and selectively lessen distance between the separate belt loops when the first end and/or the second end of the elongate sheath are advanced towards one another by gripping and applying force directly to the belt loops to bias the two belts loops towards one another while the first and second ends of the elongate sheath remain substantially coplanar relative to one another while the device is in use and affixed to the separate belt loops, wherein the first end, the second end, and the connecting portion comprise hook and loop fasteners positioned thereon in which the first and second ends comprise the same hook fastener or loop fastener and the connecting portion comprises a complimentary hook fastener or loop fastener configured to securely engage the first and second ends while the device is in use, the hook and loop fasteners continuously arranged on the device such that the hook and loop fasteners directly contact one another when the adjustable belt loop fastening device is in use and when the device is completely open in a flat position.

* * * * *